US005154078A

United States Patent [19]

Codazzi

[11] Patent Number: 5,154,078

[45] Date of Patent: Oct. 13, 1992

[54] KICK DETECTION DURING DRILLING

[75] Inventor: Daniel Codazzi, Missouri City, Tex.

[73] Assignee: Anadrill, Inc., Sugar Land, Tex.

[21] Appl. No.: 546,272

[22] Filed: Jun. 29, 1990

[51] Int. Cl.[5] ..... E21B 47/00; G01V 1/00

[52] U.S. Cl. ..... 73/155; 175/48; 367/83

[58] Field of Search ..... 73/19.09, 155, 597, 73/579, 602; 175/48; 367/81, 83, 34

[56] References Cited

U.S. PATENT DOCUMENTS

| | | | |
|---|---|---|---|
| 2,560,911 | 7/1951 | Wolf | 179/352 |
| 2,573,390 | 10/1951 | Blanchard | 73/19 |
| 3,603,145 | 9/1971 | Morris | 73/155 |
| 3,789,355 | 1/1974 | Patton | 340/18 LD |
| 4,003,256 | 1/1977 | Donelan et al. | 73/194 A |
| 4,208,906 | 6/1980 | Roberts, Jr. | 73/155 |
| 4,273,212 | 6/1981 | Dorr et al. | 181/102 |
| 4,286,461 | 9/1981 | Bres et al. | 73/155 |
| 4,299,123 | 11/1981 | Dowdy | 73/155 |
| 4,733,232 | 3/1988 | Grosso | 340/861 |
| 4,733,233 | 3/1988 | Grosso et al. | 340/861 |

OTHER PUBLICATIONS

"MWD Acoustic and Mud Resistivity Measurements for Gas Influx Detection", by T. M. Bryant, Teleco Oilfield Services, Inc., 1989.

*Primary Examiner*—Hezron E. Williams

*Assistant Examiner*—Michael Brock

*Attorney, Agent, or Firm*—Gary L. Bush; John J. Ryberg

[57] ABSTRACT

Gas influx into a wellbore, called A "kick", is detected by two different, yet complementary methods during active drilling of the borehole. The first method is based upon the existence of standing wave patterns generated by pressure oscillations of the drilling rig mud pumps. Such standing wave patterns form time sequences of maximum and minima as a gas slug moves upwardly in the annulus. The time between such peaks of such oscillations is measured and forms the basis for generation of one first kick signal. A continuous increase in the phase between annulus and drill string standing waves forms the basis for another standing wave kick signal. The second method uses acoustic signals from a downhole source near the bottom of the borehole which are transmitted at different speeds in the annulus mud and in the interior drill string mud, where the annulus mud may be gas cut. A difference in arrival time between the signals is determined, and if large enough, causes a second kick signal to be generated. A third method may be used where at least two drilling pumps are used in the drilling system. Such method determines the total travel time, from standpipe to drill string and up the annulus, of a beat frequency pressure wave caused by slightly different frequencies of the two pumps. An alarm signal is generated if the total travel time is greater than a computed threshold.

30 Claims, 11 Drawing Sheets

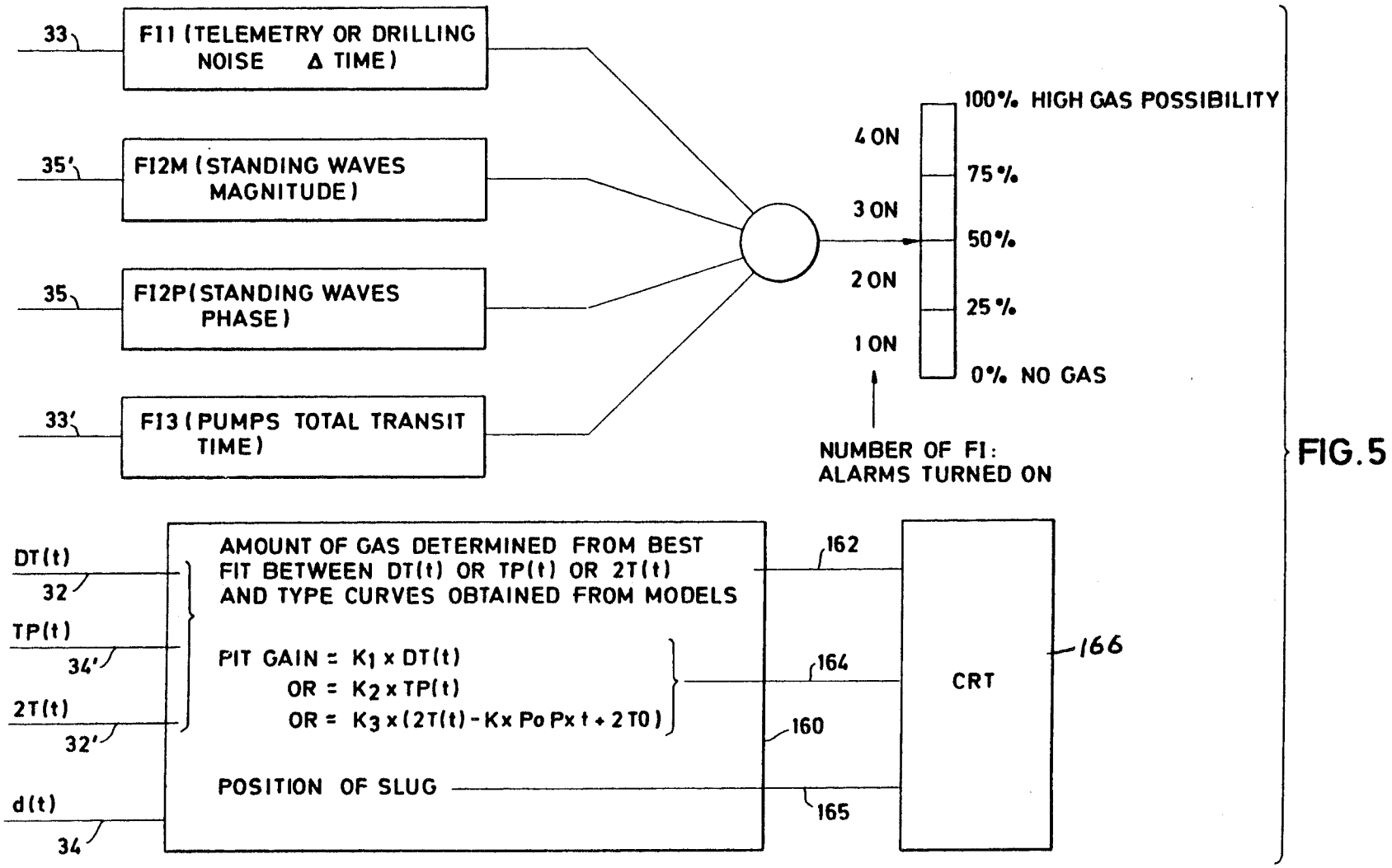
FIG. 5
100% HIGH GAS POSSIBILITY
75%
50%
25%
0% NO GAS
4 ON
3 ON
2 ON
1 ON
NUMBER OF FI: ALARMS TURNED ON
166
CRT
162
164
160
165
FI1 (TELEMETRY OR DRILLING NOISE Δ TIME)
FI2M (STANDING WAVES MAGNITUDE)
FI2P (STANDING WAVES PHASE)
FI3 (PUMPS TOTAL TRANSIT TIME)
AMOUNT OF GAS DETERMINED FROM BEST FIT BETWEEN DT(t) OR TP(t) OR 2T(t) AND TYPE CURVES OBTAINED FROM MODELS
FIT GAIN = K1 x DT(t)
OR = K2 x TP(t)
OR = K3 x (2T(t) - K x Po Px t + 2T0)
POSITION OF SLUG
33
35'
35
33'
DT(t)
32
TP(t)
34'
2T(t)
32'
d(t)
34

INFORMATION SIGNAL
PHASE SHIFT MODULATOR Δ Ø
PHASE
BANDPASS FILTER
fc
AMPLITUDE MODULATION
CARRIER SIGNAL (fc)

MUD 62
COMMUNICATION TRANSMITTER 80
MUD SUB 60
9
PHASE MODU-LATION SIGNAL
BANDPASS
AMPLITUDE MODU-LATION SIGNAL
PM
AM

KICK DETECTION DURING DRILLING

TECHNICAL FIELD

The present invention relates to the detection of influx, particularly gas influx or a "kick" into the borehole of an oil or gas well. More particularly the invention relates to acoustic detection of such gas influx during the drilling of the borehole.

BACKGROUND OF THE INVENTION

Normally, hydrostatic pressure of the drilling-fluid column is greater than pressure of formation fluids, thus preventing flow of formation fluids into the wellbore. When hydrostatic pressure drops below formation-fluid pressure, formation fluids can enter the well. If this flow is small, causing a decrease in density (mud weight) as measured at the surface, the drilling fluid is said to be "gas cut", "salt-water cut", or "oil cut" as the case may be. When a noticeable increase in mud-pit volume occurs, the typical prior art method of gas influx detection, the event is known as a "kick" . An uncontrolled flow of formation fluids into the wellbore and up to the surface is a "blowout".

As long as hydrostatic pressure controls the well, circulation is accomplished by using a flowline, or the well may be left open while the bit is removed. If a kick occurs, blowout-prevention equipment and accessories are needed to close the well. This may be done with an annular preventer, with pipe rams, or with master (blind) rams when the drill pipe is out of the hole.

In addition, means are necessary to pump drilling fluid into the well and to allow controlled escape of fluids. Injection is accomplished either down the drill pipe or through one of the kill lines, and flow from the well is controlled by a variable orifice or choke attached to a choke line. Choke lines are arranged so that well effluent can be routed to either a reserve pit where undesired fluid is discarded, or to a mud/gas separator, degasser, and mud pit where desired fluid is degassed and saved. By using this equipment, the low-density fluids are removed and replaced with a higher-density fluid capable of controlling the well.

As mentioned above, kick detection while drilling in the past has typically been indicated by observing and monitoring the mud return flow rate and/or mud pit volume. Accordingly, most rigs which use drilling mud to control the pressure in the borehole have some form of pit-level indicating device to indicate a gain or loss of mud. A mud pit-level indicating and recording device such as a chart is usually located in a position so that the driller can see the chart while drilling is occurring. When a kick occurs, the surface pressure required to contain it will largely depend upon closing in the BOP's quickly and retaining as much mud as possible in the well.

A flow meter showing relative changes in return-mud flow has also been used as an early warning device, because mud hold-up in solids control devices, degassers, and mixing equipment affects average pit-level. Such fluctuations in pit-level due to such factors recur periodically during drilling and may occur simultaneously with a kick. When such conditions are present, a return-flow rate may be the first indication of a kick.

To determine kicks as early as possible while drilling, the driller typically uses instantaneous charts of average volume of the mud pit, mud gained or lost from the pit, and return-flow rate. Preferably, the pit volume and return flow rate is recorded on the drilling floor so that trends can be established. As soon as an unexpected change in the trends of such parameters occurs, a driller checks for a kick condition.

Because a kick can lead to a blowout with possible disastrous results to the well, prior attempts have been made to obtain information as to a gas influx into the borehole before such influx affects pit mud volume or return flow rate.

For example, U.S. Pat. Nos. 4,733,233 to Grosso and Feeley and 4,733,232 to Grosso describe a technique by which a pressure transducer at the surface senses annulus acoustic variations in the returning mud flow and another pressure transducer at the surface senses drill string acoustic variations in the entering mud flow.

In the '232 patent, a downhole "wave generator" produces an acoustic signal in the sonic range. The signal is measured at the surface in the drill string and in the annulus. Changes in the measured difference between amplitude and phase of the annulus and drill string signals are said to indicate that fluid influx into the annulus has occurred.

In the '233 patent, a downhole MWD transmitter produces a train of pulses in the sub-sonic or sonic frequency range. The pulse trains are sensed at the surface in the annulus and in the drill string or standpipe with pressure transducers. A change in the amplitude of the annulus signal where no change occurs in the amplitude of the drill string signal is used to indicate the presence of a borehole fluid influx. A change in phase angle between the surface received annulus signal and the surface received drill string signal is also used to indicate a borehole fluid influx.

Such amplitude and phase comparisons of annulus and drill string surface signals which travel upwardly through the annulus and drill string respectively from an MWD communication transmitter have been found to be inaccurate under many circumstances. Amplitude comparisons of such signals are difficult in the real world environment of a drilling rig and deep borehole due to noise which is simultaneously measured in the annulus and drill string and due to variations between annulus and drill string mud temperature. The phase difference between the annulus and drill string signals is inherently ambiguous because the phase of the annulus signal may be less than or greater than 360° ($2\pi$) from that of the drill string.

The '233 patent suggests that a correlation function may be obtained between the annulus and drill string signals and that such signals have a fixed time relationship $\tau$. The patent further suggests that characteristics of the annulus and drill string may be precisely determined on a continuous basis while drilling and that if characteristics of the annulus and drill string signals are disturbed in excess of a predetermined limit, an alarm may be energized. Unfortunately, a direct correlation process as suggested by the '233 patent has been found to be useless without an explanation as to how the annulus and drill string signals are to be "conditioned" prior to the correlation process.

Another technique for determining fluid influx into the borehole while drilling is disclosed in U.S. Pat. No. 4,273,212. This patent discloses energizing a transducer to propagate an acoustic signal down the annulus between the borehole and the drill string. A receiver is provided to receive reflected acoustic energy at the surface. Such acoustic energy is reflected from the bottom of the hole and also from the interface between drilling fluid in the annulus and fluid influx. This technique is believed not to be feasible in a real drilling rig environment due to the difficulty of distinguishing reflections from the bottom of the hole, reflections from discontinuities in borehole casing, and reflections from true mud density changes caused by fluid influx. Moreover, the technique of the '212 patent suffers from a practicality viewpoint because it requires circulation through the choke.

In light of the above, a major object of the present invention is to provide a practical fluid influx system for an operating rotary drilling rig.

Another object of the invention is to provide a practical way during drilling to determine fluid influx into a borehole by comparing transit time to the surface via the annulus and with that of the drill string of an MWD communication mud pulse train.

Another object of the invention is to provide a practical way of determining fluid influx into a borehole while it is being drilled by comparing transit time to the surface via the annulus with that of the inside of the drill string of drilling noise generated by the interaction between the bit and the rock.

Another object of the invention is to provide a practical way of determining fluid influx into a borehole while it is being drilled from a standing wave analysis of the magnitude and phase of periodic acoustic signals caused by the mud pumps of the drilling rig.

Another object of the invention is to provide a practical way of determining fluid influx into a borehole while it is being drilled from the analysis of the total transit time of mud pump beats down the drillstring and up in the annulus.

Another object of the invention is to simultaneously require a fluid influx determination (1) from a mud pump standing wave analysis (2) from a mud pump beat propagation analysis and (3) from a transit time analysis of an MWD communication mud pulse train or a downhole noise source associated with the interaction between the bit and the formation before a fluid influx alarm is provided to a driller.

Another object of the invention is to provide apparatus for informing a driller as to the location and size of a gas slug that has entered the borehole.

SUMMARY

Gas influx into a wellbore, which is commonly referred to as a "kick" by oil and gas well drilling specialists after it reaches the surface, is preferably detected by two related methods during active drilling of a well bore. These methods individually or collectively achieve the objects identified above and have other advantages and features. The two methods are complementary in that one method relies on measuring acoustic energy through a gas slug while the other senses a reflection from a gas slug. Each method may be used independently to determine whether a fluid influx (usually gas) has occurred, but preferably the simultaneous detection of gas influx is required in order to generate an alarm for the driller. Both methods are preferably used in assessing the size and location of a detected fluid influx.

The first method is based upon the existence of standing wave patterns generated by pressure oscillations of the drilling rig mud pumps. When measured in the annulus and normalized by standpipe readings, such standing wave patterns form sequences of maximum and minimum peaks and valleys with a time spacing between peaks (or valleys) equal to the time needed for the gas cut mud to be displaced over a distance equal to one-half wavelength of a standing wave of a frequency of the mud pumps. A method and apparatus are provided to determine that a gas influx has occurred by detecting the presence of such peaks above a predetermined magnitude, and a standing wave gas influx signal is produced. The time between such peaks, the elapsed time from the first peak above such predetermined magnitude, the gas cut mud slug upward velocity in the borehole, and the distance that such slug has travelled from the bottom of the borehole are all determined from such standing wave method and apparatus. The phase difference between the annulus and standpipe mud pumps signals is also an excellent gas indicator. In normal steady state operation, this phase difference is $k\pi$ where k is an integer, a well known property of standing waves. Should a gas influx occur, the propagation time between the standpipe and annulus increases which translates as an increasing phase difference between the two sensors. The more gas, the faster the phase difference increases. The rate of increase with time of this phase difference is therefore also used to estimate the quantity of influx gas.

The second method assesses the difference in arrival time of modulated pulse trains arriving at the surface in the annulus drilling mud and in the drill pipe drilling mud. Carrier pulse trains are phase or frequency modulated by a modulator/transmitter in the drill string near the bottom of the borehole. Down hole measured parameters in the form of digital words are used to modulate such carrier pulse trains. Differences in surface arrival times of such digital words greater than a predetermined magnitude are indicative of gas influx. A method and apparatus are provided to determine such arrival time difference and to use it as an indicator of gas influx. Such "delta arrival time" method is based on the fact that narrow band pass filtering of the received annulus and drill pipe signals converts such original phase or frequency modulation signals to amplitude modulation signals. The amplitude modulated signals are then converted to obtain frequency power spectra for each. A cross spectrum is then obtained and Inverse Fourier transformed back into the time domain to obtain a cross correlation function between the two amplitude modulation signals.

The absissa of the maximum of such cross correlation function corresponds to the difference in arrival time of the annulus and drill pipe signals. Such function is determined in real time thereby producing a signal DT(t) of the real time delay between the received annulus and drill pipe signals. The amplitude of DT(t) is indicative of gas influx if it is greater than a predetermined maximum value. If the amplitude of DT is greater than such maximum value, a DT fluid influx signal is generated.

It is a good practice to normalize the cross correlation function with the geometric average of the signals spectra. The result is the cross correlation coefficient whose magnitude varies between $-1$ and $+1$. The magnitude of the cross correlation coefficient is an indicator of the quality of the correlation. Perfectly correlated traces have a correlation coefficient close to 1 whereas poorly correlated or noisy signals have a much lower correlation coefficient. This property serves as a rejection or validation criteria for the estimators of DT(t).

Some variance or scatter on the estimation of DT results from calculations performed on truncated time traces of finite bandwidth. This variance has to be kept to a minimum so that it does not mask trends or variations of DT versus time that are related with gas entry in the wellbore. Classical techniques of overlapping along with the use of long time traces (typically 20 seconds) are used to diminish the variance. Another technique, specific to this application, is also implemented: For each set of annulus and standpipe data blocks, different estimators of DT(t) are calculated, each corresponding to a slightly different value of the center frequency of the band-pass digital filter used to produce the amplitude modulation signals that are correlated to produce DT(t). For example, considering the case of a carrier frequency of 12 Hz, five estimators of DT are obtained with setting the band pass filter center frequency to 11, 11.5, 12, 12.5, and 13 Hz. These five estimators are then averaged together to produce an estimation of DT with less variance or scatter.

In a particularly preferred embodiment of the present invention, the DT determination kick signal and the standing wave kick signal are both required to be present in order to prevent a false kick indication.

In yet another particularly preferred embodiment of the present invention, a third method can be used to back up the two previous ones in the case where two or more mud pumps are used in parallel. In this situation, it is common practice to operate the pumps at the same flowrate. Experience shows that this practice produces pressure beatings in the standpipe and that these beatings propagate down and up in the annulus. The beating frequency which is proportional to the difference in frequency of the two pumps is usually very low, for example 0.1 Hz. A phase difference of the beats between standpipe and annulus is a direct measurement of the sonic travel time 2T down the drillstring and up in the annulus, and therefore of the presence of gas if an exponential increase of such travel time is detected.

The amount of gas of the detected gas influx is determined from a predetermined tabulated function of DT (difference in arrival time) or 2T (Total transit time) and the distance that a gas slug influx has travelled from the bottom of the borehole.

BRIEF DESCRIPTION OF THE DRAWINGS

The objects, advantages and features of the invention will become more apparent by reference to the drawings which are appended hereto and wherein like numerals indicate like elements and wherein an illustrative embodiment of the invention is shown, of which:

FIG. 5 illustrates system elements provided for insuring the accuracy of a fluid influx determination to create a driller's alarm information and for producing detailed information concerning the amount of gas such fluid influx and its effect on the mud volume in the rig mud pit;

DESCRIPTION OF THE INVENTION

Figure 1:
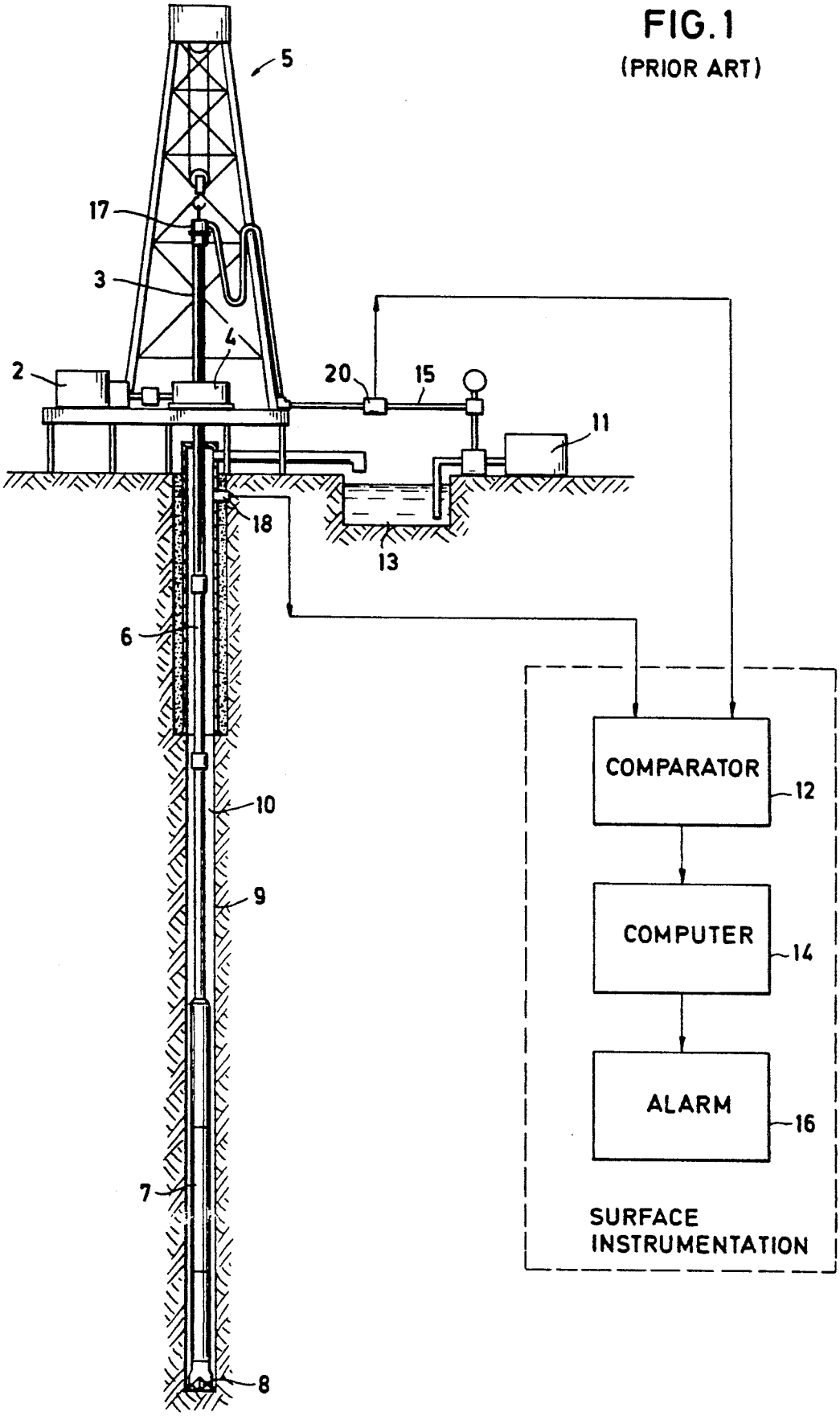
FIG. 1 (PRIOR ART)
FIG. 1 is a prior art system diagram for determining gas influx in a well bore while drilling by comparing annulus and drill string acoustic signals at the surface which are induced by a down hole mud pulse communication transmitter.

FIG. 1 illustrates a prior art rotary drilling rig system having apparatus for detecting a down hole influx of fluid (usually gas) into the annulus of the borehole. The rotary drilling system environment is familiar to those skilled in the art of oil and gas drilling.

The drilling rig 5 includes a motor 2 which turns a kelly 3 by means of a rotary table 4. A drill string 6 includes sections of drill pipe connected end to end and to the kelly and turned thereby. A plurality of drill collars and MWD tools 7 are connected to the drill string 6 and are terminated by a rotary drill bit 8 which forms the borehole 9 as it is turned by the drill string.

Drilling fluid or "mud" is pumped by pump 11 from mud pit 13 via stand pipe 15 and revolving injector head 17 through the hollow center of kelly 3 and drill string 6 to the bit 8. The mud acts to lubricate drill bit 8 and to carry borehole cuttings upwardly to the surface via annulus 10 defined between the outside of drill string 6 and the borehole 9. The mud is delivered to mud pit 13 where it is separated of borehole cuttings and the like, degassed, and returned for application again to the drill string.

The drilling mud in the system not only serves as a bit lubricant and the means for carrying cuttings to the surface, but also provides the means for controlling fluid influx from formations through which the bit 8 is drilling. Control is established by the hydrostatic head pressure of the column of drilling fluid in annulus 10. If the hydrostatic head pressure is greater than the trapped gas pressure, for example, of a formation through which the drill bit 8 is passing, the gas in the formation is prevented from entering the annulus 10. Various agents may be added to the drilling mud to control its density and its capacity to establish a desired hydrostatic head pressure.

The mud column inside the drill string 6 also serves the purpose of providing an acoustic transmission path for down hole measuring while drilling signals. The above mentioned U.S. Pat. Nos. 4,733,233 and 4,733,232 illustrate that digital pulses of mud pressure may be established downhole near the bit 8 and that such pulses may be detected and the information carried by them determined at the surface.

Such patents also suggest that a fluid influx into borehole 9 may be detected by providing a pressure transducer 18 at the surface to sense annulus pressure and pressure transducer 20 in stand pipe 15 to sense drill string pressure. These transducers compare the drill string and the annulus acoustic or pressure signals generated by the MWD communication transmitter located near the bottom of the borehole. A gas influx in the annulus 10 affects certain characteristics of the annulus transmitted signal, but not the signal in the drill string 6. Such patents teach providing a comparator 12 where the amplitude and/or phase of the annulus signal and drill string signal may be compared. The patents indicate that a computer 14 may be used to assess the output of the comparator 12 so as to generate an alarm in circuit 16 if a fluid influx in detected.

Figure 2:
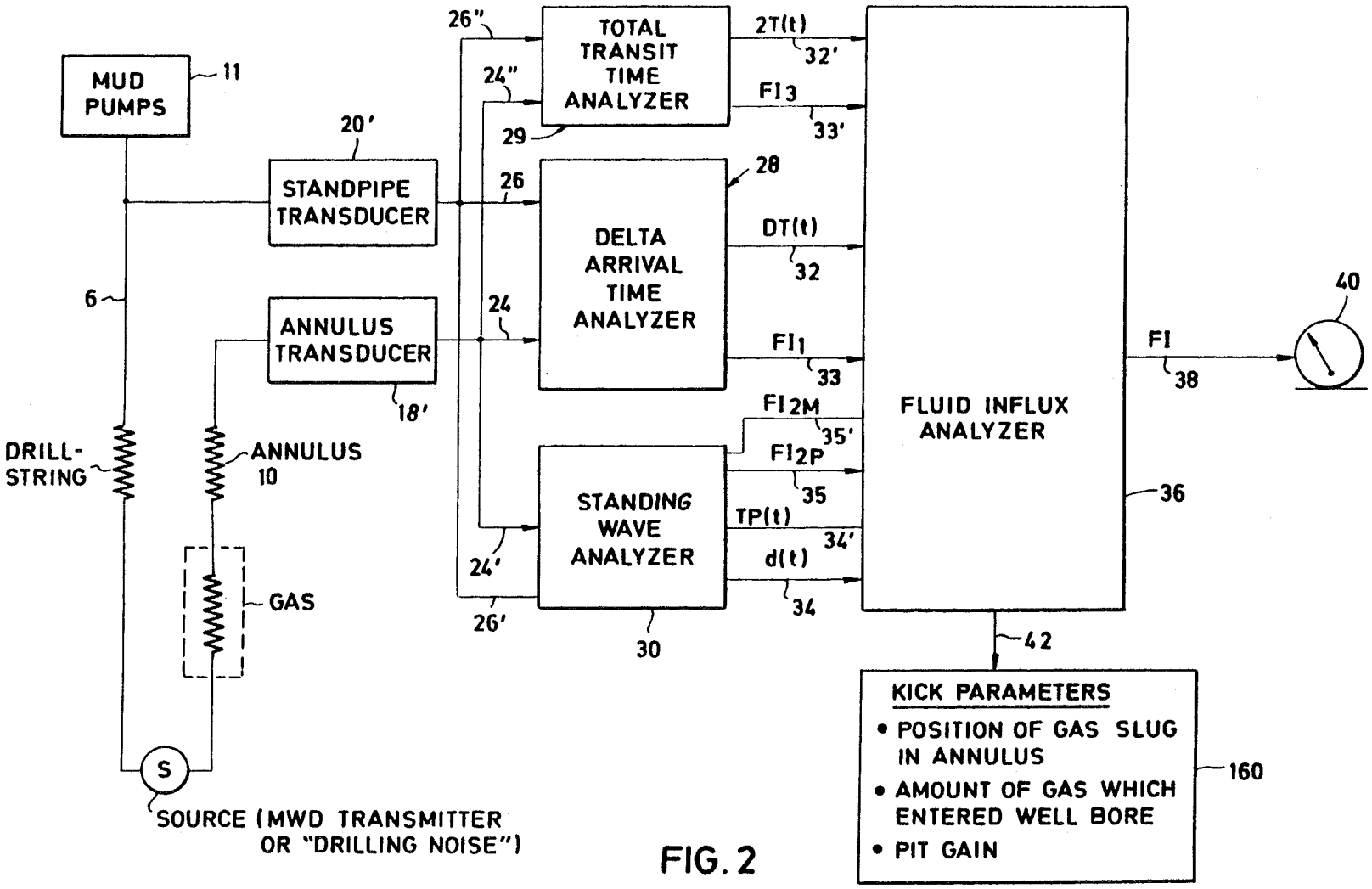
FIG. 2 is a system block diagram according to the invention where drill string and annulus signals are processed according to standing wave and difference in arrival time techniques as well as total transit time techniques to obtain independent fluid influx signals.

The present invention follows a somewhat similar principle in that it likewise uses annulus and drill string pressure signals to determine downhole fluid influx while drilling, but uses different signal sources and techniques to generate confirmatory fluid influx signals. FIG. 2 illustrates that an annulus transducer 18' and standpipe transducer 20' are disposed at the surface in a manner similar to that illustrated in FIG. 1. The drill string signal from standpipe transducer 20' and the annulus signal from annulus transducer 18' are applied to "Delta Arrival Time Analyzer" 28 via leads 26 and 24, respectively. The drill string and annulus signals are also applied to a standing wave analyzer 30 by means of leads 24' and 26', and to a total transit time analyzer 29 by means of leads 24'' and 26''.

The Delta Arrival Time Analyzer 28 generates a DT(t) signal on lead 32 representative of the difference in arrival time of a down hole source of sound via the annulus and via the drill string. This downhole source can, for example, either be an MWD signal transmitter or drilling noise generated at the bit and resulting from the interaction between the bit and the rock. In practice, the strongest of the two is preferably selected. Such signal is generated in real time t. If such DT(t) signal meets certain predetermined criteria, a Fluid Influx signal, called $FI_1$, is generated on lead 33.

The Standing Wave Analyzer 30 generates a d(t) signal on lead 34 representative of the distance a fluid influx or "gas slug" has moved from the bottom of the borehole toward the surface as a function of time t measured from the time of entry ts into the borehole of such influx. It also generates on lead 34' an estimation of the variation of the total propagation time TP(t) down the standpipe and up in the annulus. TP(t) is obtained from the phase curve versus time of the standpipe to annulus frequency response curve at the pump frequency. Also generated is an alarm $FI_2P$ on lead 35 and $FI_2M$ on lead 35'. This alarm is activated when the change in total propagation time TP(t) is positive.

The total transit time analyzer 29 generates on lead 32' a total transit time 2T(t) representing the transit time down the drill string and up in the annulus determined from the pump beatings. In a preferred embodiment of the present invention, the total transit time analyzer 29 is used when two or more pumps are operating at roughly the same flowrate. An alarm FI3 is generated on lead 33' when an exponential increase in 2T(t) is determined.

The "Kick" or Fluid Influx Analyzer 36 responds to the $FI_1$ signal on lead 33, to the $FI_2$ signals on leads 35 and/or 35', and to the $FI_3$ signal (if two mud pumps are used) on lead 33' to issue an alarm fluid influx signal FI on lead 38 for driving a bell 40 or the like for sounding an alarm at the driller's control station of the drilling rig 5.

The Fluid Influx Analyzer 36 also preferably generates signals on lead 42 representative of the position of the gas slug in the annulus, the amount of gas or size of a gas slug which entered the well bore, and the pit gain as will be described hereinafter in greater detail. These signals may be used to provide real time information to the driller concerning a gas influx by means of a CRT display, a printer, plotter or the like positioned at a location convenient to the driller.

Figure 3:
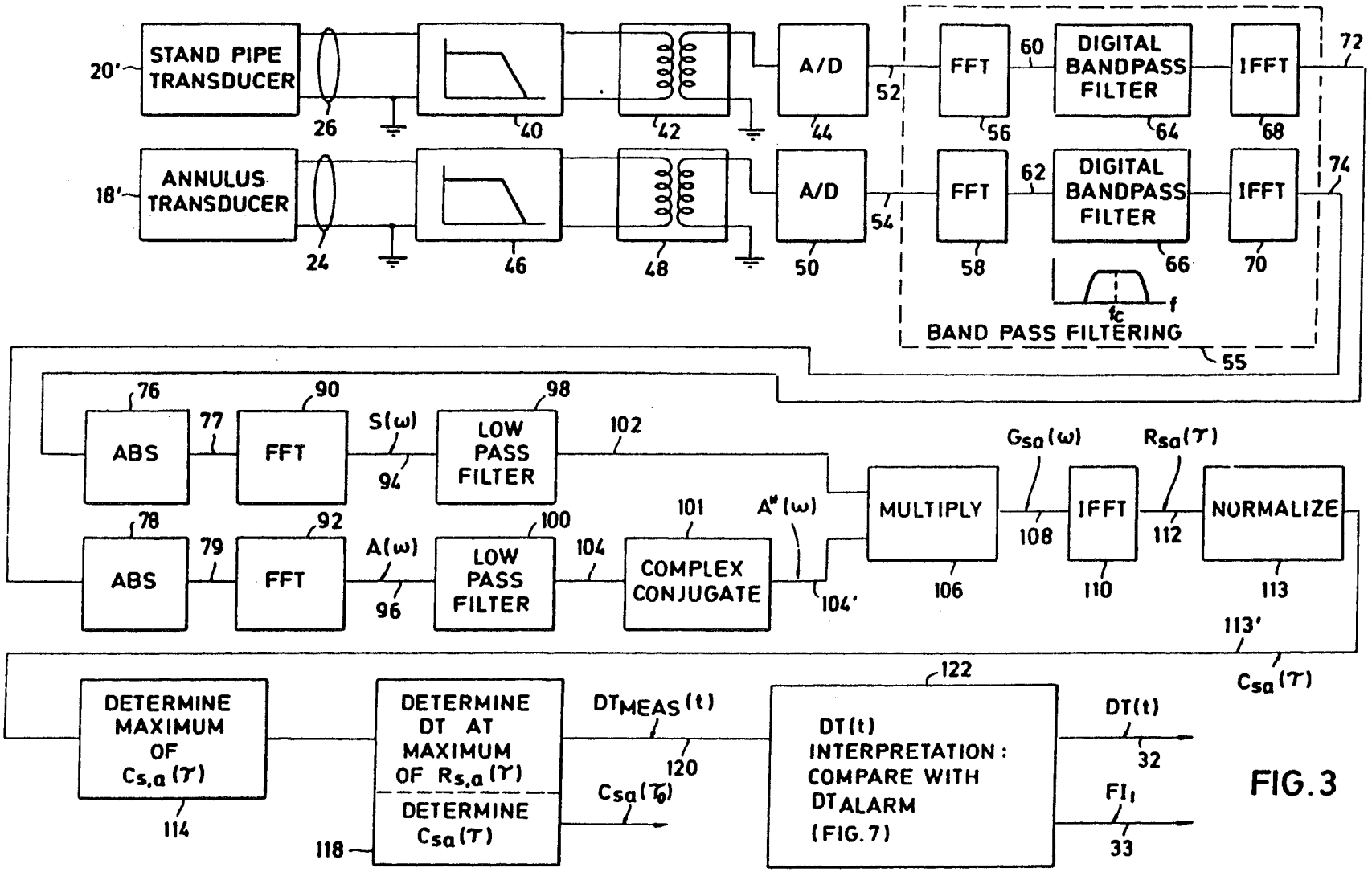
FIG. 3 is a block diagram illustrating the difference in arrival time method and apparatus for real time detection of a fluid influx in a borehole.

FIG. 3 illustrates the preferred hardware circuits and computer instrumentation to realize the Delta Arrival Time Analyzer 28 of FIG. 2. This circuit is used when the downhole source is the MWD telemetry modulator. The drill pipe pressure signal from standpipe transducer 20' is applied via leads 26 to a low pass antialiasing filter 40, a.c. coupling device 42, and an A/D circuit 44. The annulus pressure signal from annulus transducer 18' is likewise applied via leads 24 to a low pass filter 46, a.c. coupling device 48, and an A/D circuit 50. The drill string signal appears in digital form on lead 52; the annulus signal appears in digital form on lead 54.

Figures 6A, 6B, 6C:
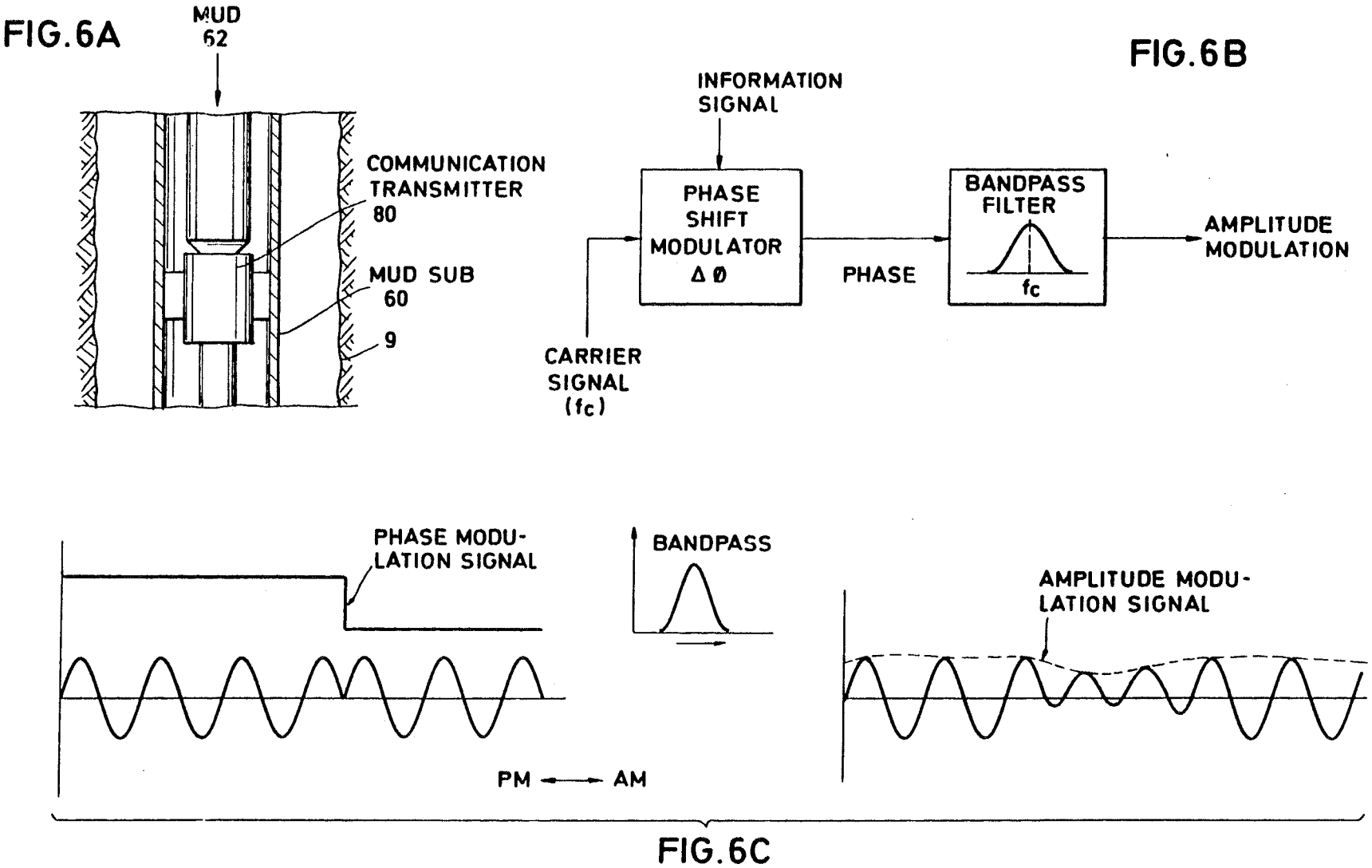
FIG. 6A illustrates a communication transmitter of an MWD system which produces a carrier signal of mud pressure pulses which are modulated by downhole measurements for transmission via the drill string mud path to the surface of the drilling rig for processing.
FIGS. 6B and 6C illustrate that an MWD carrier signal modulated in phase by a downhole information signal may be band pass filtered about the carrier frequency to produce a signal, the amplitude modulation of which is related to such information signal.

The signals appearing on leads 52 and 54 are representative of the mud pulse train created by a measuring while drilling communication transmitter located a short distance above the drilling bit in the borehole 9 e.g., transmitter 80 illustrated schematically in FIG. 6A as part of MWD sub 60. Such transmitter, described for example in U.S. Pat. Nos. 3,309,656 and 4,785,300 and incorporated by reference herein, produces a carrier train of pulses in the mud 62. The train of pulses is typically characterized by a center frequency $f_c$ representative of the pulse rate of the carrier. The pulse rate is phase or frequency modulated, that is slowed down or speeded up, in accordance with measurement parameters measured down hole. In other words, the phase or frequency of the pulse train carrier is modulated in accordance with information signals desired to be transmitted to the surface.

The modulated signals are detected at the surface and demodulated so as to determine the information concerning measurements of downhole parameters. For purpose of the present invention, however, it is useful to determine the difference in arrival time to the surface of the modulated signal as it travels along one mud path via the interior of drill string 6 with the arrival time to the surface of the modulated signal as it travels along the alternative mud path via the drill bit and up to the surface via annulus 10.

It is important to assess the arrival time of the same signal at the surface via these alternative paths. The phase shift caused by a gas influx may be greater than 360°, making it difficult to compare the arrival time of two signals on the basis of phase differences.

Where the carrier pulse train is phase modulated, as illustrated schematically in FIG. 6B, there is an equivalence between the information of the amount of phase shift imposed on the carrier pulse train and the amplitude of such signals after they have been passed through a narrow band pass filter centered at the carrier frequency of the carrier pulse train. In other words, such filtering of a phase modulated carrier pulse train converts the phase modulation to a signal the amplitude of which varies with the information signal imposed on or modulating the carrier pulse train. Such equivalence is also illustrated in FIG. 6C.

Accordingly, where the MWD transmitter includes a phase shift modulator of a carrier frequency, as schematically illustrated in FIG. 6, passing such signal through a band pass filter having a center frequency equal to that of the carrier frequency, produces a signal the amplitude modulation of which replicates the information signal which modulated the downhole signal. Accordingly, and referring again to FIG. 3. the signals appearing on leads 52 and 54 are phase modulated pulse trains and are applied to digital band pass filters 55 in the following manner. Each time domain signal on leads 52 and 54 is applied respectively to a Fast Fourier Transform module 56, 58 to convert it to a frequency spectrum on leads 60, 62. Multiplication by the frequency response curve of band pass filters 64, 66 and Inverse Fast Fourier Transform modules 68, 70 convert the drill string and annulus signals to time domain signals on leads 72, 74. The amplitudes of these time domain signals vary with the down hole information used to modulate the carrier pulse train.

Next, the signals are applied to absolute value modules 76, 78, and then to Fast Fourier Transform modules 90, 92 via leads 77, 79. The output of FFT modules 90, 92 on leads 94, 96 are frequency spectra S(w) and A(w), the spectra for the drill string and the annulus signals as previously processed. The spectra are multiplied by the frequency response curve of low pass filters 98, 100 to produce the frequency representation of the envelope or amplitude modulation signal of the telemetry carrier on leads 102 and 104. The spectrum of the annulus channel is applied to a complex conjugation module 101 to produce an output on lead 104' The annulus complex conjugate spectrum and standpipe spectrum are multiplied together in module 106 to produce the cross power spectrum of the drill string and annulus amplitude modulation signals. Such cross power spectrum on lead 108 is applied to Inverse Fast Fourier Transform module 110. The output of module IFFT 110 on lead 112 is the cross correlation function $R_{sa}(\tau)$ where $\tau$ is the lead or lag time between the drill string signal s(t) and the annulus signal $a(\tau)$. Consequently, at each moment in real time t, the correlation function $R_{sa}(\tau)$ is produced.

The cross correlation function $R_{sa}(\tau)$ is then normalized by the geometric mean of the signal's power spectra in module 113 to produce, the cross correlation coefficient $C_{sa}(\tau)=R_{sa}(\tau)\sqrt{(rss(O)Raa(O))}$.

Next, in module 114. the maximum of the cross correlation coefficient $C_{sa}(\tau O)$ is determined and the lag or lead time $\tau_O$ at such maximum, defined as the difference in arrival time DT, is determined in module 118. The output of module 118 is applied on lead 120 as a real time signal DT(t). The value of correlation function $C_{sa}(\tau O)$ is used as an indication of the quality of the measurement in the following exemplary way: if $C_{sa}(\tau_O)$ is larger than 0.9, then the measurement is valid; otherwise, the measurement is rejected and the previously calculated value of DT(t) is maintained on lead 120.

Figure 7:
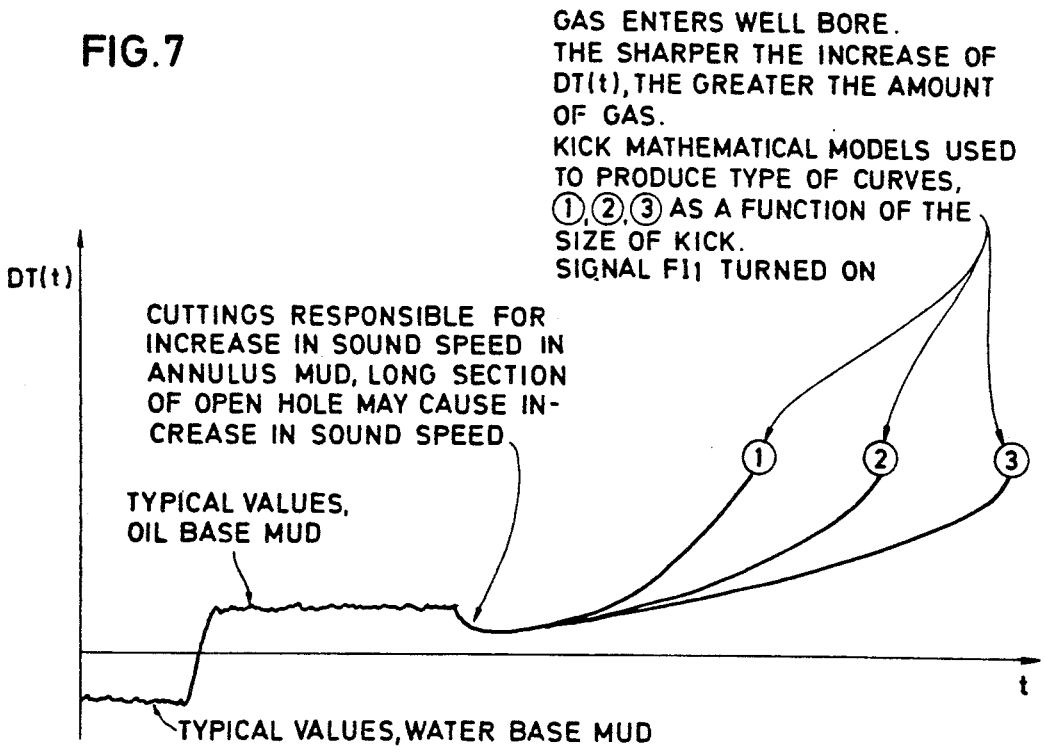
FIG. 7 illustrates DT(t) signals which are produced by the apparatus of FIG. 3 and indicates processing steps used to identify the magnitude of a gas influx in the difference in arrival time method and apparatus.

The time signal DT(t) is plotted versus time and interpreted as illustrated on FIG. 7. In normal drilling operations, DT(t) is almost a constant. The value of this constant is a function of the particular situation of the well being drilled, of the location of the MWD transmitter within the bottom hole assembly (BHA), and of the location of the surface receiving transducers. These parameters are normally constants during the drilling process.

The presence of cuttings in the annulus is responsible for an increase in annulus acoustic speed and therefore for negative values or trends of DT(t) toward lower values. Sound speed is increased due to cuttings, because cuttings increase the bulk modulus of the mud.

When using oil base mud, the average speed of sound over the entire length of the annulus is generally lower than the average speed of sound in the drill string. The reason for this phenomenon is the presence of dissolved gas in the mud, which is more likely to come out of solution in the annulus since the annulus pressure is less than the pressure inside the drill string. Because sound speed is lower in gas cut mud, pressure pulses take a longer time to travel up in the annulus and thus the larger value of the delay DT(t).

The influx of formation gas into the wellbore is characterized by an exponential increase of DT versus t. This behavior has been observed experimentally and mathematical models predict these effects. Use of these models provides curves that each correspond to a different size kick. Referring to FIG. 7, curve (3) corresponds to a 1 barrel kick; curve (2) to a 3 barrel kick; and the curve 1 to a 10 barrel kick. Determining the similarity between tabulated curves and measured curves can be performed in real time using, for instance, least square criteria or by minimizing a previously defined distance between the type of curves and the measured curves. When a similarity between the measured DT(t) curve and type curves stored in the memory of a computer is established, then a fluid influx signal $FI_1$ is output on leads 32, 33 as illustrated in FIG. 2.

It is well known that under certain circumstances, wide frequency band noise can be generated downhole in connection with the interaction between the bit and the rock. This noise propagates up in the annulus as well as in the drill string and its magnitude, especially in the annulus, can be several times larger than the magnitude of the pressure pulses associated with MWD telemetry. When such a situation occurs, the delta arrival time method described above is subject to failure because of poor signal to noise ratio. Nevertheless, it has been discovered that it is possible to continue the same general type of measurement and analysis by using the drilling noise as a sound or mud pressure source instead of the MWD transmitter. However, due to the nature of drilling noise, the processing of the signals is different, although the result is still the same: there is a difference in transit time of pressure waves propagating inside the drill string and in the annulus.

Figure 8:
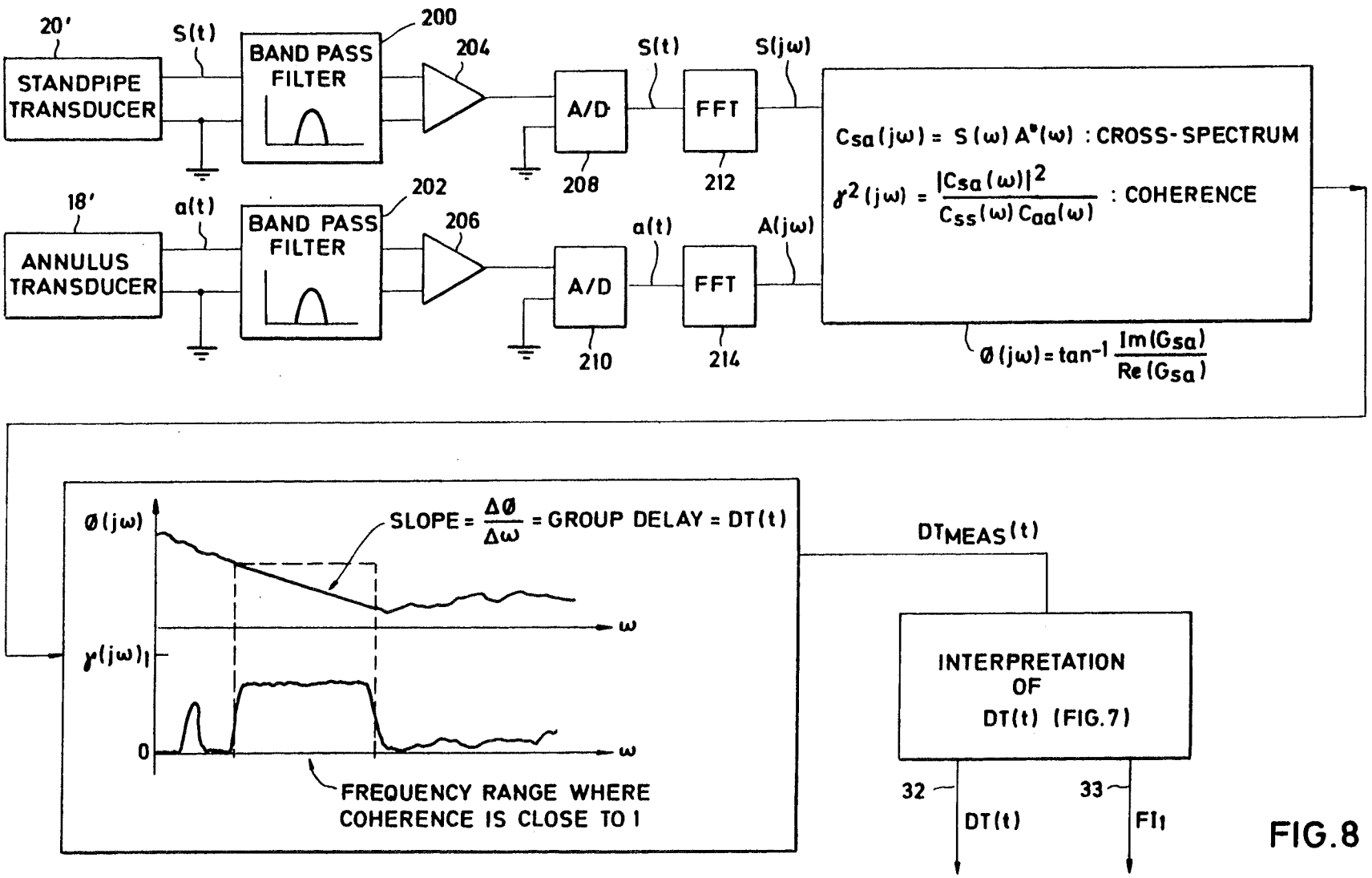
FIG. 8 illustrates instrumentation of the difference in arrival time method and apparatus where the downhole signal source is drilling noise.

The signal processing in this latter case is preferably performed according to the schematic presented in FIG. 8. Prior to analog to digital conversion, the annulus and standpipe signals are band pass filtered by filters 200, 202. The lower end cut-off frequency is adjusted in such a way that any mud pump or telemetry signals are rejected. Practically, this cut off frequency is of the order of 24 Hz. The high pass cut-off frequency serves anti-aliasing aliasing purposes. In practice, it is preferably set at approximately 400 Hz. After the band pass filters, the signals are amplified by instrumentation amplifiers 204, 206 in order to take full advantage of the A/D dynamic input range. After the conversion to digital form by A/D converters 208, 210, the standpipe signal S(t) and the annulus signal a(t) are Fourier transformed in modules 212, 214 to produce respectively the spectra S(w) and A(w). The next step is to determine the cross spectrum $C_{sa}(w)=S(w)A^*(w)$ and the coherence $\text{Gamma}^2|C_{sa}(w)|^2/C_{ss}(w)C_{aa}(w)$ where $C_{ss}(w)=S(w)S^*(w)$ and $C_{aa}(w)=A(w)A^*(w)$ denote respectively the standpipe and annulus power spectra, and where * indicates complex conjugation. Coherence is an indication of the statistical validity of the cross spectrum measurement. The next step is to calculate the phase of the cross spectrum as a function of frequency. This phase $\phi$ (w) is calculated as the inverse tangent of the ratio of the imaginary part to the real part of the cross spectrum. The group delay, which is the final goal of these calculations, is the negative slope $-d\phi/dw$. It is calculated over a frequency band where the coherence is close to 1. This process is illustrated in FIG. 8. The value of $DT(t)=\tau_O$ is equal to $-d\phi/dw$. The interpretation performed on DT(t) is the same as when DT(t) was calculated with the MWD transmitter as a source as explained in detail earlier herein.

If desired, the fluid influx signal $FI_1$, on lead 33 (FIG. 2) could be used to sound an alarm by means of a bell or the like at the driller's control station, but it is preferred to simultaneously determine fluid influx from one or more independent methods. One such independent method is based on monitoring and analyzing standing waves due to the drilling rig mud pumps.

Figures 4A, 4B:
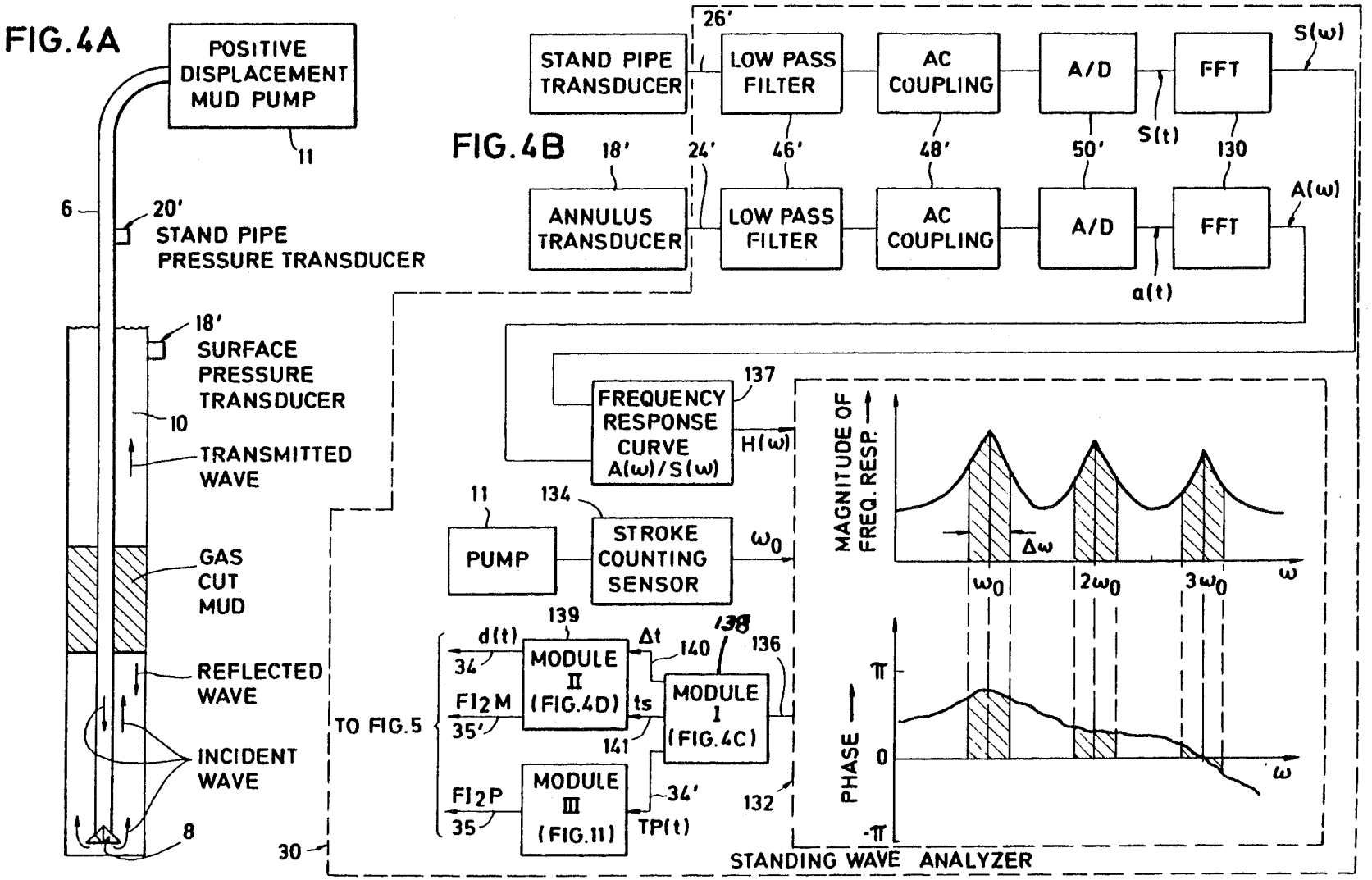
FIG. 4A illustrates how mud-pump induced standing waves are altered by gas influx into the annulus of a borehole.
FIG. 4B illustrates the determination of the standpipe to annulus frequency response curve which is carried out at frequencies corresponding to the mud pumps fundamental and two first harmonics.

FIG. 4A generally illustrates how a gas influx into the annulus 10 of the borehole affects standing waves in the annulus set up by the vibration or noise of mud pumps 11. The vibration waves propagate down drill string 6, out the drill bit 8 and upwardly toward the surface of the annulus. If a gas slug is in the well, such vibration waves are partially reflected from the bottom of the slug and, as a consequence, the standing wave pattern is altered. Part of such waves is transmitted to the surface via annulus 10 where it is sensed by annulus transducer 18'.

FIG. 4B illustrates the standing wave signal processing according to a preferred embodiment of the present invention. The annulus pressure signal detected by anulus transducer 18' on lead 24' is applied to low pass filter 46', to a. c. coupling circuit 48', and then to A/D circuit 50'. The standpipe pressure signal detected by stand pipe transducer 20' on lead 24' is applied to a similar low pass filter 46', to a similar AC coupling circuit 48', and then to A/D circuit 50'. The conditioned signals a(t) and s(t) for annulus and standpipe respectively are then transformed into the frequency domain by means of FFT modules 130 to produce signals A(w) and S(w) which are then transmitted to a frequency response curve calculation module 137. The frequency response curve H(w)=A(w)/ S(w) is the ratio of the cross spectrum S*(w)A(w) to the input power spectrum S*(w)S(w), where * indicates complex conjugation. The magnitude and phase of H(w) are then averaged over a frequency band of width Delta w centered on $W_o$, the pump fundamental frequency. The same averaging is subsequently performed for the first and second harmonics $2W_o$ and $3W_o$. The results are denoted by SWi for the magnitude and $\phi$i for the phase where the subscript i is 0 for the fundamental and 1, 2, . . . for the harmonics 1, 2, . . .

Simpler and less computing power consuming methods well known to those skilled in the art of signal processing can be used. For example, since the frequency response curve for certain values of the frequency is needed, it is not necessary to perform a complete Fourier Transform of the signals. Sine and cosine transforms at the frequencies of interest will generally suffice. However, with the Delta arrival time apparatus available as illustrated in FIG. 3, the Fourier transforms of the standpipe and annulus traces are already available and therefore might just as well be used.

The angular frequencies $W_i$ correspond to the mud pump fundamental frequency and to its harmonics. This information is obtained independently from another sensor, usually a stroke counting sensor 134 mounted on one piston of the pump. Should two pumps be used, then the analysis is performed on 4 frequency bands (i.e., the two fundamentals and the two first harmonics of the two pumps).

Referring again to FIG. 4B, the bandwidth Delta w is adjusted to obtain the best compromise between scatter of the results (this requires large Delta W) and meaningfulness of the result (low values of Delta W) because SWO and SW1 must be representative of the magnitude of the acoustic pressure within the frequency band of the mud pumps. Typical values of Delta w are in the range between 0.005 and 0.05 Hz.

The next step is to plot SWi and $\phi$i (and their equivalents if a second mud pump is used) versus time as drilling progresses. The curves illustrated in FIG. 4C are typical of what is obtained.

The SWi curves are characterized primarily by oscillations with a periodicity equal to the time necessary to drill a length of hole whose length is equal to one-half wave length at the considered frequency $Wi$. These periodic peaks are related to resonances of the system constituted by the drill string inside a borehole of finite length. For instance, at a rate of penetration of 100 feet per hour, the time to drill one half wavelength is 8 hours. It is obvious that the periodicity on the plot of SW1 is one half that of SW0 because the frequency corresponding to SW0 is half the frequency corresponding to SW1.

If an influx occurs at time ts, then the periodicity in the plots of SWi is increased by a great amount because now it corresponds to the time needed for the boundary of the gas cut slug of mud to move upward over a distance equal to one half wavelength, and that the rise velocity of the slug is much larger compared to the rate of penetration.

Figure 4C:
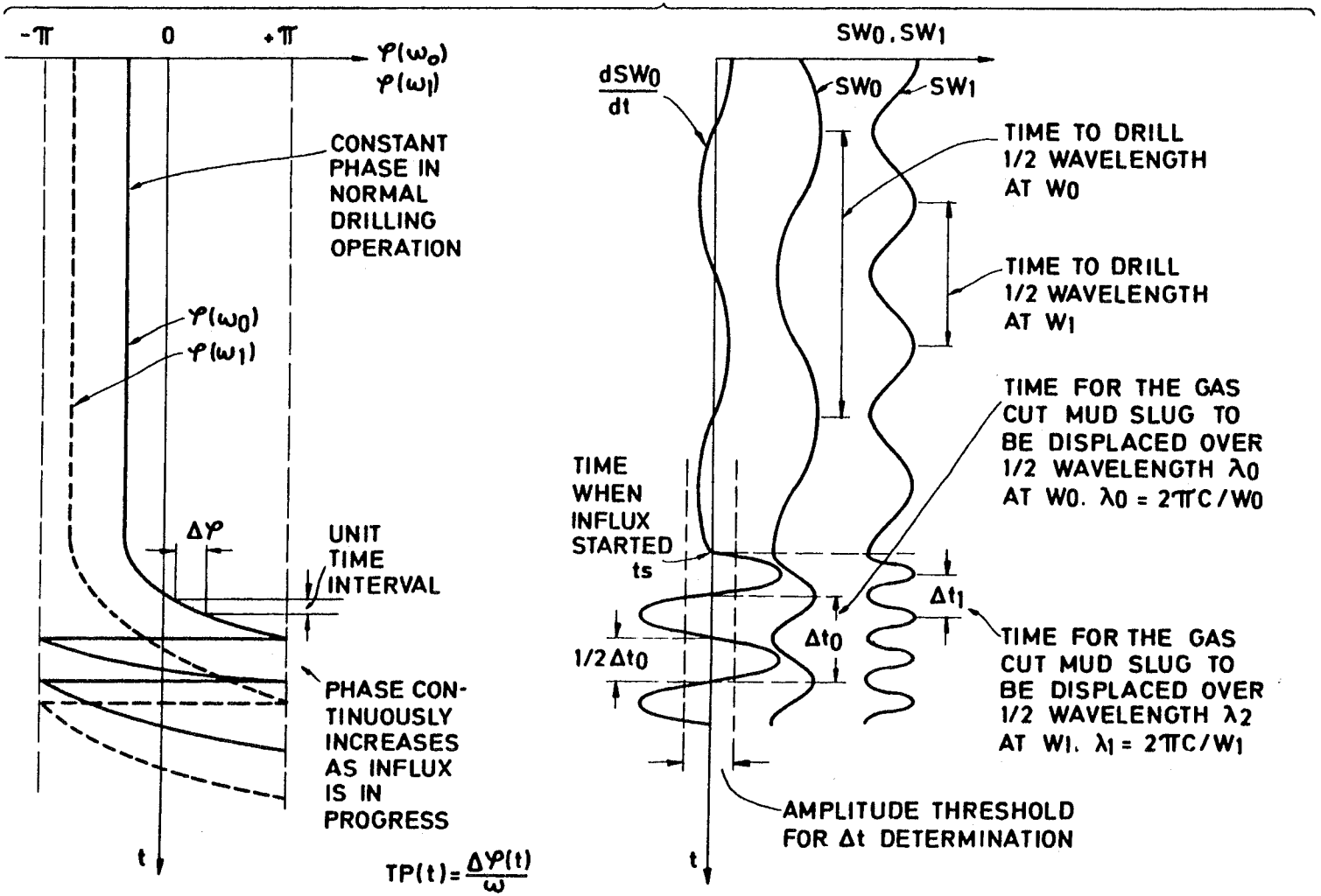
FIG. 4C illustrates the time variation of the magnitude and phase of the frequency response curve determined as indicated in FIG. 4B and indicates the effect on such signals when a gas influx enters the annulus of the borehole.

Module I 138 (FIG. 4B) in response to the SW0, SW1 signals on lead 136 determines the time Delta t between peaks of oscillations of SW0 or SW1 according to the steps outlined in FIG. 4C.

The measurement of Delta t, the time for the slug to be displaced over ½ wavelength, is complicated by the fact that oscillations of the plot of SWi are not only due to the slug effect. As discussed above, the drilling process as it goes on is also responsible for oscillations in SWi. Therefore, a determination of Delta t on the sole basis of the distance between consecutive peaks or valleys is not suitable.

The discrimination is made on the basis of how steep the peaks are and from a practical viewpoint, the method used for determining the time intervals Delta t between oscillations is based on analyzing the derivative versus time of the SWi traces. One-half Delta t is the time between zero crossings of dSWi/dt. Only those zero crossings where |dSWi/dt| is larger than a predetermined threshold are considered. This is equivalent to setting a threshold on how steep the peaks are.

Of great importance also is the determination of the time $t_s$, the time when the influx started. Time $t_s$ is determined as the first zero crossing of the derivative of Sw0 versus time that satisfies the threshold criteria on the absolute value larger than a predetermined threshold.

The practical determination of the threshold can be made by setting this threshold to 150% of the average value of the magnitude of the derivative of SW0 versus time measured over a time interval where there is no influx, for instance at the beginning of drilling when the hole depth is shallow.

After two peaks or more are measured and a time Delta t determined between them, a Delta t signal is applied from module 138 to Module II 139 of FIG. 4B (Module 142 of FIG. 4D) via lead 140 and a $t_s$ signal is applied to module 146 (FIG. 4D) via lead 141.

Figure 4D:
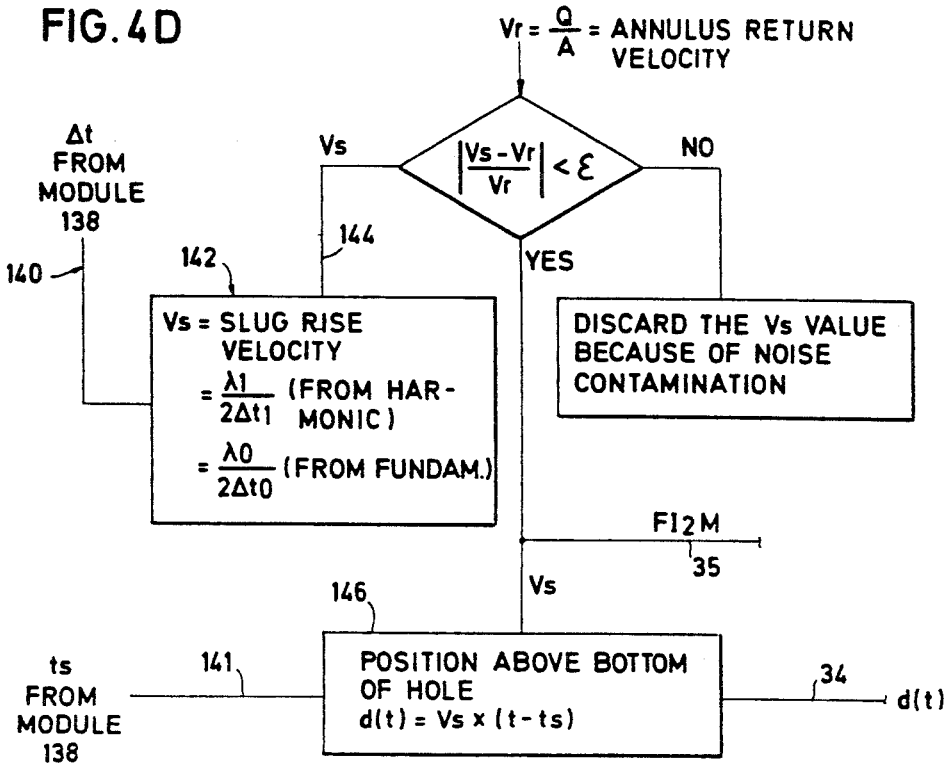
FIG. 4D illustrates how slug rise velocity is determined and its use in determining the distance from the bottom of the borehole that the gas slug has traveled.

Module 142 of FIG. 4D accepts the measurement signal Delta t on lead 140 and divides the predetermined one-half wavelength ½ lambda by the signal Delta t to determine a gas slug velocity signal on lead 144. The calculation of the slug rise velocity $v_s$ is primarily based on the ½ wavelength and Delta t corresponding to the mud pump fundamental, i.e. ½ $lambda_0$ and Delta $t_0$. Another estimate of vs can be obtained using the ½ wavelength lambdal and Delta $t_1$ corresponding to the first harmonic. The next step is a consistency check.

The consistency check uses the mud flow rate Q and the annulus cross section area A known from hole size and drill bit size. The mud return velocity $v_r=Q/A$ is determined. Next, $v_s$ and $v_r$ are compared, which can be implemented practically by calculating $|v_s-v_r|/v_r$ and comparing this to a predetermined ratio $\epsilon$. For example, the value for $\epsilon$ can be set to 0.3. Two cases are considered:

i) If $|v_s-v_r|/v_r>\epsilon$, the consistency check test fails. The measured value of $v_s$ is meaningless and should be discarded. This typically occurs in the case of poor signal to noise ratio or in connection with an event that is unrelated to gas entry into the wellbore.

ii) If $|v_s-v_r|/v_r>\epsilon$, the consistency check test succeeds. A fluid influx alarm $FI_2M$ is output on lead 35' (see also FIG. 2) and $v_s$ can be used to determine the position of the gas slug at time t. This is performed in module 146. The position above the bottom of the hole d(t) is given by $d(t)=vs(t-t_s)$ and output on lead 34. The $t_s$ signal determined in module 138 as explained above is connected to module 146 via lead 141.

Figure 11:
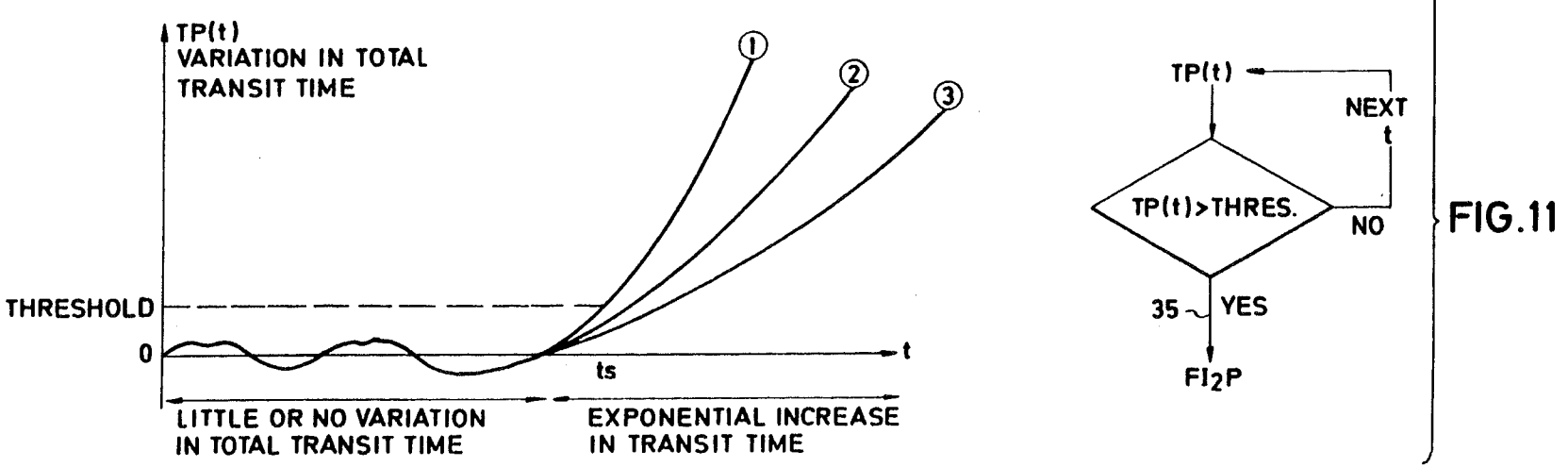
FIG. 11 illustrates additional processing steps used to identify gas influx.

The left hand side of FIG. 4C illustrates plots of phase $\phi i(t)$ (for i=o and $\phi i=1$) versus time t. In the normal drilling mode, the value of $\phi i(t)$ is in theory equal to k $\pi$ with k being an integer, which is a well known property of standing waves. In practice, $\phi i(t)$ is equal to some constant different from k $\pi$, because additional phase shift between stand pipe and annulus are introduced by the amplifiers of the sensors as well as the AC coupling and antialiasing filters which are not absolutely identical. At the time $t_s$, when gas is entering the wellbore, the phase $\phi i(t)$ starts increasing because the standpipe to annulus propagation time increases. Since phases are measured modulo $2\pi$, the only possible values are between $-\pi$ and $+\pi$. Thus, every time the increasing $\phi i(t)$ reaches $+\pi$, it is reset to $-\pi$ x and continues to increase from there. The resulting visual effect is a "rolling" of $\phi i(t)$. The larger the influx, the faster the rolling. This is assessed by measuring Delta $\phi(t)$, the amount $\phi i(t)$ has increased during an arbitrary unit time interval. The next step is to calculate the variation in total transit time TP(t)=Delta $\phi(t)/w$ and to plot it against time t as indicated in FIG. 11. Whenever an influx takes place, TP(t) exceeds a predetermined threshold and exhibits an exponential behavior. Different size kicks produce the curves labeled 1, 2, 3, in order of decreasing size of the kick. A kick mathematical model is used to produce type curves 1, 2, 3. An alarm $FI_2P$ (P stands for phase) is output to the fluid influx analyzer 36 on lead 35 whenever TP(t) exceeds the threshold.

FIG. 5 illustrates the 4 basic individual fluid influx signals being applied to Fluid Influx Analyzer 36. A consolidated fluid influx alarm is elaborated from the FI's in the following way: if none of the FI's is on, then the probability of there being a gas influx is set to zero. If one indicator FI turns on, then it is assured that a 25% chance of gas influx is present and a 25% display is set on the driller's console, 50% for 2 FI's, 75% for 3, and 100% when all four FI's are turned on.

It is of course possible to attribute more weight to one of the FIs and less to another in the computation of the consolidated alarm. When only one pump is being used, the FI3 indicator does not exist and the remaining indicators account for 33.3% each. On wells being drilled without MWD, the FII indicator does not exist and the remaining indicators account for 33.3% each. On a well being drilled with only one pump and without MWD, the FI1 and FI3 indicators do not exist and the remaining indicators account for 50% each.

Still referring to FIG. 5, the DT(t) signal on lead 32 from the Delta Arrival Time Analyzer 28, the d(t) signal on lead 34 from the Standing Wave Analyzer 30, the 2T(t) signal on lead 32' from the total transit time analyzer 29, and the TP(t) signal on lead 34' from standing wave analyzer 30 are applied to kick or Fluid Influx Parameter module 160. Predetermined relationships f(DT(t), f(2T(t)), f(TP(t)), stored in computer memory produce a signal on output lead 162 representative of the amount or magnitude of a gas influx slug, that is, $amt_{gas}(t)$.

Another predetermined relationship between the DT, 2T or TP signals and pit gain are stored in computer memory, and a pit gain signal as a function of t is applied on lead 164. The $amt_{gas}(t)$ signal and the PIT GAIN (t) signal may be presented on CRT display 166 or an alternative output device such as a printer, plotter, etc. The position of the gas slug may be applied to CRT 166 via lead 165.

In another particularly preferred embodiment of the present invention, a third gas influx detection method can be used to back up the two previous ones in the case where two or more mud pumps are used in parallel. When this occurs, it is common practice to operate the pumps at approximately the same flowrate. Experience proves that this produces a beating frequency pressure wave in the standpipe and that these beatings propagate down and up in the annulus. The beating frequency, which is proportional to the difference in frequency of the two pumps, is usually very low, for example 0.1 Hz. A phase difference of the beats between standpipe and annulus is a direct measurement of the sonic travel time 2T down the drillstring and up in the annulus, and therefore of the presence of gas if an exponential increase of such travel time is detected.

Figure 9:
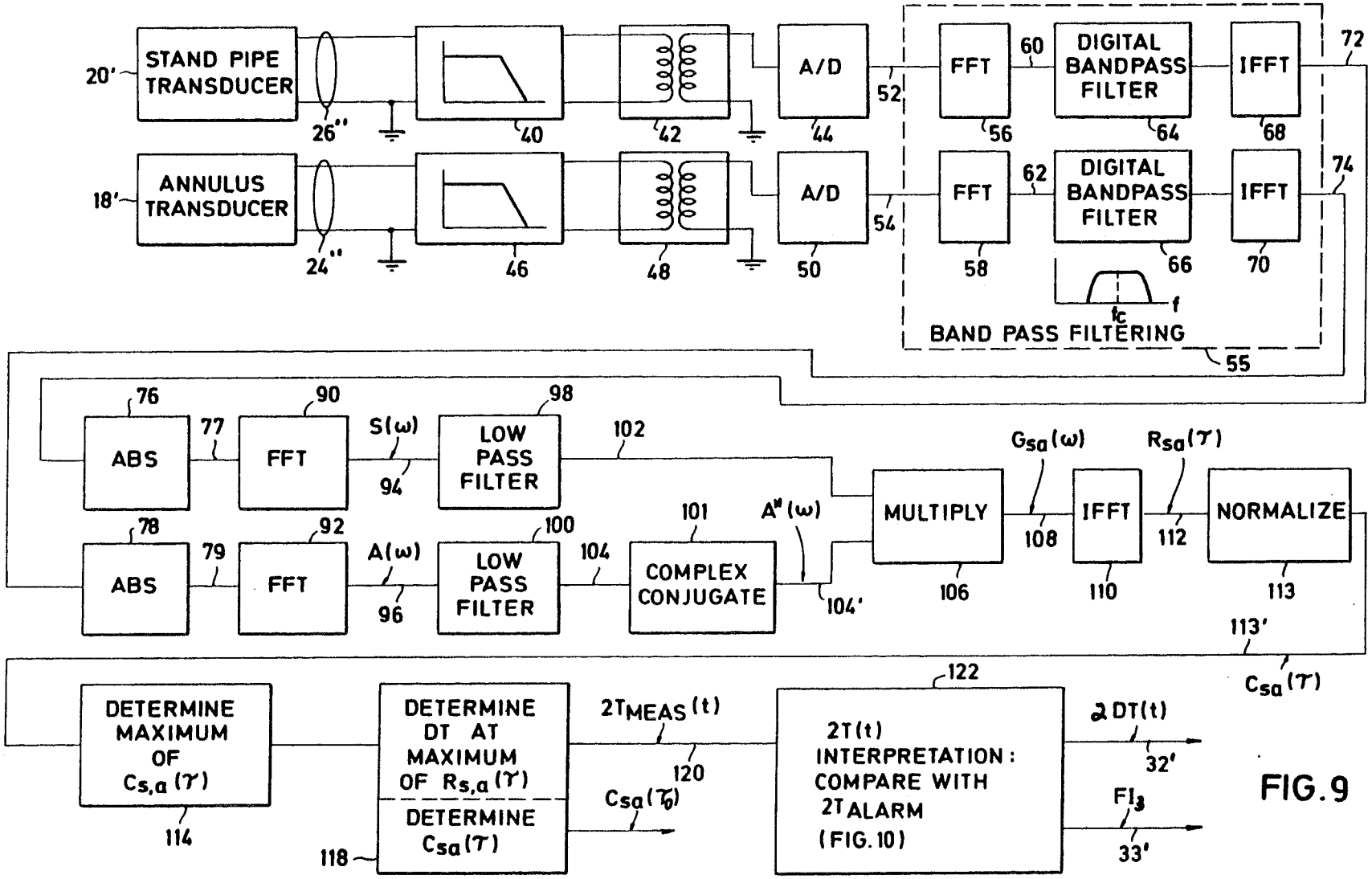
FIG. 9 is a block diagram showing the method used to measure 2T(t), the total transit time down the drillstring and up the annulus in the case where pump beatings are present, the technique being similar to the one used for DT(t), the difference in arrival times from the downhole source.
Figure 10:
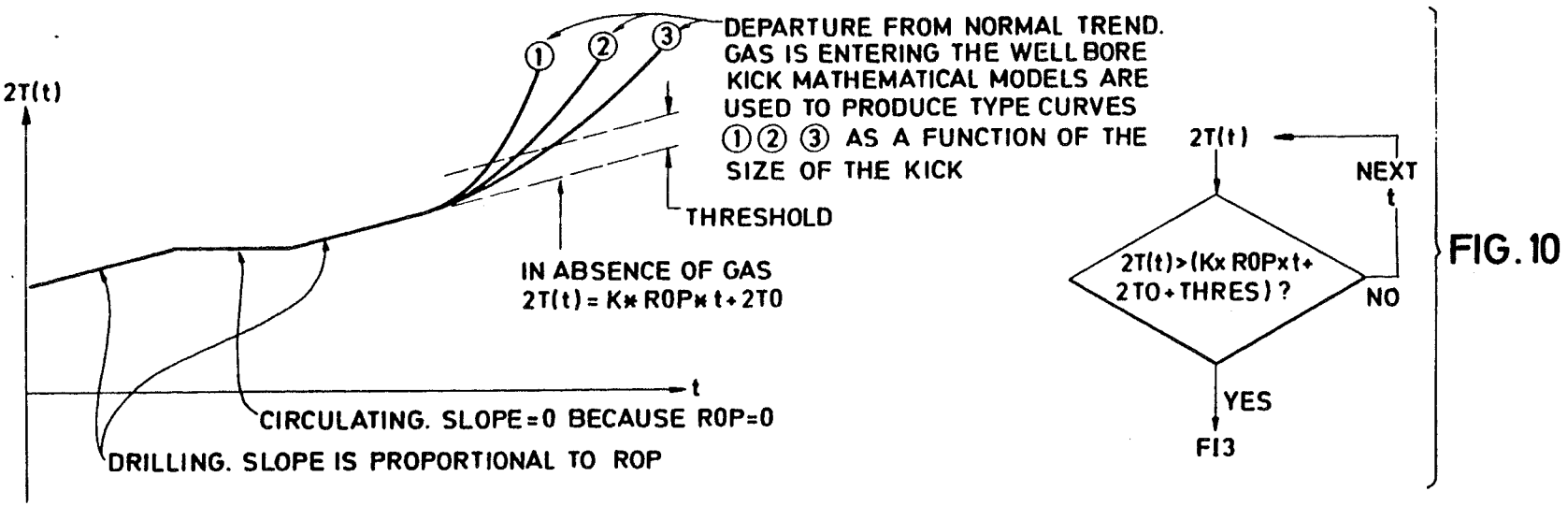
FIG. 10 illustrates 2T(t) signals which are produced by the apparatus of FIG. 9 and indicates processing steps used to identify the occurrence of a gas influx as well as to estimate its magnitude.

FIGS. 9 and 10 illustrate the pressure beating wave phase difference method and apparatus. FIG. 9 represents the total transit time analyzer 29 of FIG. 2 with inputs 26'' and 24'' from the standpipe transducer 20' and annulus transducer 18'. FIG. 9 is identical in structure to that of FIG. 3 which illustrates the delta arrival time from a downhole source apparatus and method.

The band pass filtering of module 55 of FIG. 9 is set to the pump fundamental frequency. The same steps described above for FIG. 3 are repeated by the module of FIG. 9 with the exception that the output of logic module 118 is now the total travel time of the beat frequency wave, that is $2T_{meas}(t)$ which is applied to logic module 122 of FIG. 10.

Referring to FIG. 10, when the 2T(t) function is plotted as a function of time, it normally has an increasing slope with rate of penetration. If the 2T(t) slope increases dramatically, i.e., exponentially, such increase is an indication of a fluid influx. If the value of 2T(t) at any time t is greater than K x ROP x t +2T0 +threshold, then a third alarm $FI_3$ is generated on lead 33' as indicated in FIGS. 10 and 2.

The detection methods described above are complementary or confirmatory of each other because some are "integral" type of measurements and others are "differential". The delta arrival time analyzer apparatus and method which uses either the telemetry or the drilling noise as stimulation source is of the integral type. So is the total transit time analyzer apparatus and method which uses pumps beats propagation as well as the phase information of the standing waves analyzer apparatus and method. On the other hand, the magnitude information of the standing waves analyzer apparatus and method is of the "differential" type. The term integral is used in connection with the delta arrival time or total transit time or phase of standing waves methods, because they are sensitive to the average distribution of gas in the annulus along its entire height. Accordingly, it is difficult to assess from it alone all of the parameters characteristic of a gas influx into the borehole. For example, a small amount of gas at the top of the well has the same effect as a large amount of gas at the bottom of the well, because the gas is compressed at the bottom due to the large hydrostatic head there. In other words, the same amount of gas will have very different effects on the Delta T determination depending on the position of the gas slug in the annulus.

The magnitude of the standing wave analyzer method may be characterized as a differential measurement because it is the acoustic impedance difference or "break" at the interface between clean mud and gas cut mud as a result of gas influx that governs the peaks in the standing waves. Reflections take place at the location of the impedance break or at the location of different mud densities independently of the size of the region containing the gas cut mud.

Various modifications and alterations in the described methods and apparatus will be apparent to those skilled in the art of the foregoing description which does not depart from the spirit of the invention. For this reason, these changes are desired to be included in the appended claims. The appended claims recite the only limitation to the present invention. The descriptive manner which is employed for setting forth the embodiments should be interpreted as illustrative but not limitative.

What is claimed is:

1. In a borehole drilling system including a drill string in a borehole with the drill string defining an annulus between the outer diameter of the string and the borehole, said system including a drilling fluid pump for pumping drilling fluid via a surface standpipe and thence downwardly through said drill string and upwardly via said annulus to the surface, said drilling system having a communication transmitter disposed near the lower end of said drill string for transmitting down hole measurement parameters to the surface via said drilling fluid, said transmitter producing a carrier pressure pulse train which is modulated in response to said down hole measured parameter, apparatus for detecting fluid influx into the borehole comprising:

a) pressure detecting means near the surface of said system for detecting said modulated pressure pulse train in said annulus which is transmitted to the surface from said transmitter and for generating an annulus pressure signal corresponding thereto;

b) pressure detecting means near the surface of said system for detecting said modulated pressure pulse train in said standpipe which is transmitted to the surface from said transmitter via said drill pipe and for generating a standpipe pressure signal corresponding thereto, c) surface instrumentation means responsive to said annulus pressure signal and to said standpipe pressure signal for determining the difference in arrival time at the surface of said modulated pressure pulse train via said annulus and said modulated pressure pulse train via said standpipe to produce a difference in arrival time signal $DT_{meas}$; and d) means for comparing said difference in arrival time signal $DT_{meas}$ with a predetermined difference in arrival time signal $DT_{alarm}$ to generate a signal if $DT_{meas} > DT_{alarm}$.

2. The apparatus of claim 1 wherein said surface instrumentation means comprises:

first band pass filter means responsive to said modulated pressure pulse train in said standpipe for converting same to a standpipe signal;

second band pass filter means responsive to said modulated pressure pulse train in said annulus for converting same to an annulus signal;

Fourier transforming means for determining the Fourier frequency spectrum S(w) signal corresponding to the absolute value of said standpipe signal and the complex conjugate Fourier frequency spectrum A*(w) signal corresponding to the absolute value of said annulus signal, means for multiplying said S(w) signal by said A*(w) signal to produce a cross power-density spectrum signal $G_{s,a}(w)$, inverse Fourier transforming means responsive to said cross power-density spectrum signal for determining a cross correlation signal $R_{s,a}(t)$, and means for determining the time $\tau$ corresponding to the maximum value of said cross correlation signal $R_{s,a}(t)$ and generating said difference in arrival time signal DT(t).

3. The apparatus of claim 2 wherein said first and second band pass filters are digital band pass filters each having its center frequency equal to a fundamental frequency of said carrier pressure pulse train.

4. In a borehole drilling system including a drill string defining an annulus between the outer diameter of the string and the borehole, said system including a drilling fluid pump for pumping drilling fluid downwardly through said drill string and upwardly through said annulus to the surface, apparatus for detecting fluid influx into the borehole comprising;

a) pressure detecting means near the surface of said system for generating an annulus pressure signal which is representative of pressure oscillation of said drilling fluid in said annulus caused by said drilling fluid pump;

b) pressure detecting means near the surface of said system for generating a standpipe pressure signal which is representative of pressure oscillation of said drilling fluid in said standpipe caused by said drilling fluid pump;

c) transform means for determining a frequency response signal H(w) proportional to the ratio of the cross spectrum of said annulus pressure signal and said standpipe pressure signal to the power spectrum of said standpipe pressure signal;

d) band pass filter means for band-pass filtering said frequency response signal about a pump frequency of said drilling pump to produce a signal SW which oscillates as a function of drilling time.

e) oscillation peak determination means responsive to said signal SW for generating a time signal proportional to the time between peaks of oscillations which are greater than a predetermined maximum amplitude of said signal SW, and f) kick determination means responsive to said time signal for indicating a fluid influx into said borehole.

5. The apparatus of claim 4 further comprising:

e) kick velocity determination means responsive to said time signal and to a predetermined signal indicative of a half wavelength of a standing wave in the drilling fluid flow path for generating a kick velocity signal.

6. The apparatus of claim 5 wherein said kick velocity determination means includes means for dividing said predetermined signal indicative of said half wavelength by said time signal thereby producing a slug velocity signal of a gas influx into said borehole.

7. The apparatus of claim 4 wherein said band pass filter means is set to a center frequency substantially equal to a fundamental frequency of said pump or integer harmonic thereof.

8. In a borehole drilling system including a drill string defining an annulus between the outer diameter of the string and the borehole, such system including a drilling fluid pump for pumping drilling fluid through a surface standpipe and thence downwardly through said drill string and upwardly through said annulus to the surface, said drilling system having a communication transmitter disposed in said drill string for transmitting downhole measurement parameters to the surface through said drilling fluid, said transmitter producing a carrier pressure pulse train which is modulated by said downhole measured parameters, apparatus for detecting fluid influx into the borehole comprising:

a) pressure transducer means in the annulus at the surface of said system for generating an annulus pressure signal proportional to pressure variations in said annulus;

b) detecting means for detecting said modulated pressure pulse train in said annulus pressure signal which is transmitted to the surface from said transmitter through said drilling fluid in said annulus and for generating a first annulus signal corresponding thereto;

c) pressure transducer means in said standpipe for generating a drill string pressure signal proportional to pressure variations in said drill string;

d) detecting means for detecting said modulated pressure pulse train in said drill string signal which is transmitted to the surface from said transmitter through said drilling fluid in said drill string and for generating a standpipe signal corresponding thereto, e) first surface instrumentation means responsive to said first annulus signal and to said standpipe signal for determining the difference in arrival time at the surface of said modulated pressure pulse train through said annulus and said modulated pressure pulse train through said standpipe to produce a difference in arrival time signal $DT_{meas}$, f) comparison circuit means responsive to said difference in arrival time signal $DT_{meas}$ and a predetermined difference in arrival time signal to generate a first fluid influx signal;

g) detecting means responsive to said annulus pressure signal for generating a second annulus signal responsive to pressure oscillation in said drilling fluid caused by said drilling fluid pump;

h) detecting means responsive to said standpipe pressure signal to generating a second standpipe signal which is representative of pressure oscillation of said drilling fluid in said standpipe caused by said drilling fluid pump;

i) transform means for determining a frequency response signal H(w) proportional to the ratio of the cross spectrum of said second annulus pressure signal and said second standpipe pressure signal to the power spectrum of said second standpipe pressure signal, j) band pass filter means for band-pass filtering said frequency response signal about a pump frequency of said drilling pump to produce a signal SW which oscillates as a function of drilling time, k) oscillation peak determination means responsive to said signal SW for generating a time signal proportional to the time between peaks of oscillation which are greater than a predetermined maximum amplitude of said signal SW, l) kick determination means responsive to said time signal for producing a second fluid influx signal; and m) alarm circuit means responsive to said first influx signal and to said second influx signal for producing an alarm signal.

9. The apparatus of claim 8 wherein said pressure pulse train is phase modulated and wherein said detecting means for detecting said modulated pressure pulse train in said drill string signal comprises:

first band pass filter means responsive to said modulated pressure pulse train in said standpipe for converting same to a standpipe signal the amplitude of which is modulated corresponding to the phase modulation of said carrier pulse train.

10. The apparatus of claim 8 wherein said pressure pulse train is phase modulated and wherein said detecting means for detecting said modulated pressure pulse train in said annulus pressure signal comprises:

second band pass filter means responsive to said modulated pressure pulse train in said annulus for converting same to an annulus signal the amplitude of which is modulated corresponding to the phase modulation of said carrier pulse train.

11. The apparatus of claim 8 wherein said first surface instrumentation means comprises:

Fourier transforming means for determining the Fourier frequency spectrum S(w) signal corresponding to the absolute value of said standpipe signal and the complex conjugate Fourier frequency spectrum A*(w) signal corresponding to the absolute value of said annulus signal;

means for multiplying said S(w) signal by said A*(w) signal to produce a cross power-density spectrum signal $G_a(w)$;

inverse Fourier transforming means for determining a cross correlation signal $R_{s,a}(t)$; and means for determining the time $\tau$ corresponding to the maximum value of said cross correlation signal $R_{s,a}(\tau)$ and generating said maximum difference in arrival time signal DT(t).

12. The apparatus of claim 8 further comprising:

j) kick velocity determination means responsive to said time signal and to a predetermined signal indicative of a half wavelength of a standing wave in the drilling fluid flow path for generating a kick velocity signal.

13. The apparatus of claim 12 wherein said kick velocity determination means includes means for dividing said predetermined signal indicative of said half wavelength by said time signal thereby producing a slug velocity signal of a gas influx into said borehole.

14. The apparatus of claim 13 wherein a distance signal proportional to the distance that a gas influx has moved upwardly from said bottom of said borehole is generated by multiplying said slug velocity signal by a signal representative of time measured from a first peak of said oscillation of said filtered annulus pressure signal which is greater than said predetermined maximum amplitude of said annulus pressure signal.

15. The apparatus of claim 14 further comprising:

means for generating a signal representative of an amount of fluid influx into said borehole in response to said distance signal and said difference in arrival time signal.

16. In a borehole drilling system including a drill string in a borehole with said drill string terminating with a drill bit and defining an annulus between the outer diameter of said drill string and said borehole, said system including a drilling fluid pump for pumping drilling fluid through a surface standpipe and thence downwardly through a drilling fluid path in said drill string, and upwardly through a drilling fluid path in said annulus to the surface, said drill bit creating a noise signal which propagates upwardly through said drill string fluid path and through said annulus drilling fluid path, a method for detecting fluid influx into the borehole comprising:

a) pressure detecting means near the surface of said system for detecting said noise signal in said annulus which is transmitted to the surface from said drilling bit and for generating an annulus pressure signal corresponding thereto;

b) pressure detecting means near the surface of said system for detecting said noise signal in said standpipe which is transmitted to the surface from said drill bit and for generating a standpipe pressure signal corresponding thereto;

c) surface instrumentation means responsive to said annulus pressure signal and to said standpipe pressure signal for determining the difference in arrival time at the surface of said noise signal in said annulus and said noise signal in said standpipe to produce a difference in arrival time signal $DT_{meas}$; and d) means for comparing said difference in arrival time signal $DT_{meas}$ with a predetermined difference in arrival time signal $DT_{alarm}$ to generate a signal if $DT_{meas} > DT_{alarm}$.

17. The apparatus of claim 16 wherein said surface instrumentation means comprises:

means for determining a cross spectrum of said standpipe pressure signal and of said annulus pressure signal;

means for determining a phase signal of said cross spectrum signal as a function of frequency w, means for determining a coherence signal of said cross spectrum signal as a function of frequency w, means for determining said $DT_{meas}$ signal by determining the slope of said cross spectrum phase signal as a function of frequency w over a region of frequency w where said coherence signal of said cross spectrum signal is approximately unity.

18. In a borehole drilling system including a drill string in a borehole with the drill string defining an annulus between the outer diameter of said drill string and the borehole, such system including a drilling fluid pump for pumping drilling fluid through a surface standpipe and thence downwardly through said drill string and upwardly through said annulus to the surface, drilling system having a communication transmitter disposed near the lower end of said drill string for transmitting down hole measurement parameters to the surface through said drilling fluid, said transmitter producing a carrier pressure pulse train which is modulated in response to said down hole measured parameter, a method for detecting fluid influx into the borehole comprising the steps of:

a) detecting near the surface of said system said modulated pressure pulse train in said annulus and generating an annulus pressure signal corresponding thereto;

b) detecting near the surface of said system said modulated pressure pulse train in said standpipe and generating a standpipe pressure signal corresponding thereto;

c) determining the difference in arrival time at the surface of said modulated pressure pulse train in said annulus and said modulated pressure pulse train in said standpipe to produce a difference in arrival time signal $DT_{meas}$; and d) comparing said difference in arrival time signal $DT_{meas}$ with a predetermined difference in arrival time signal $DT_{alarm}$ and generating a signal if $DT_{meas} > DT_{alarm}$.

19. The method of claim 18 wherein said step of determining the difference in arrival time comprises:

converting said modulated pressure pulse train in said standpipe to a standpipe signal;

converting said modulated pressure pulse train in said annulus to an annulus signal;

determining the Fourier frequency spectrum S(w) signal corresponding to the absolute value of said standpipe signal and the complex conjugate Fourier frequency spectrum A*(w) signal corresponding to the absolute value of said annulus signal;

multiplying said S(w) signal by said A*(w) signal to produce a cross power-density spectrum signal $G_{s,a}(w)$;

transforming said cross power-density spectrum signal into a cross correlation signal $R_{s,a}(t)$; and determining the time $\tau$ corresponding to the maximum value of said cross correlation signal $R_{s,a}(t)$ and generating said difference in arrival time signal DT(t).

20. In a borehole drilling system including a drill string defining an annulus between the outer diameter of said drill string and said borehole, said system including a drilling fluid pump for pumping drilling fluid downwardly through said drill string and upwardly through said annulus to the surface, a method for detecting fluid influx into the borehole comprising the steps of:

a) producing an annulus pressure signal which is representative of pressure oscillation of said drilling fluid in said annulus caused by said drilling fluid pump;

b) producing a standpipe pressure signal which is representative of pressure oscillation of said drilling fluid in said standpipe caused by said drilling fluid pump;

c) producing a frequency response signal H(w) proportional to the ratio of the cross spectrum of said annulus pressure signal and said standpipe pressure signal to the power spectrum of said standpipe pressure signal;

d) band pass filtering said frequency response signal about a pump frequency of said drilling pump to produce a filtered pressure signal;

e) generating a time signal proportional to the time between peaks of oscillations which are greater than a predetermined maximum amplitude of said frequency response signal; and f) generating an alarm signal indicating that a fluid influx has occurred into said borehole in response to said time signal.

21. The method of claim 20 further comprising the step of:

e) generating a kick velocity signal in response to said time signal and to a predetermined signal indicative of a half wavelength of a standing wave in the drilling fluid flow path.

22. The method of claim 21 wherein said step of generating a kick velocity signal includes a substep of dividing said predetermined signal indicative of said half wavelength by said time signal thereby producing a slug velocity signal of a gas influx into said borehole.

23. The method of claim 20 wherein said step of bandpass filtering includes setting a center frequency substantially equal to a fundamental frequency of said pump or integer harmonic thereof.

24. In a borehole drilling system including a drill string in a borehole with said drill string terminating with a drill bit and defining an annulus between the outer diameter of said drill string and said borehole, said system including a drilling fluid pump for pumping drilling fluid through a surface standpipe and thence downwardly through a drilling fluid path in said drill string, and upwardly through a drilling fluid path in said annulus to the surface, said drill bit creating a noise signal which propagates upwardly through said drill string fluid path and through said annulus drilling fluid path, a method for detecting fluid influx into the borehole comprising the steps of:

a) detecting near the surface of said system said noise signal in said annulus which is transmitted to the surface from said drilling bit and generating an annulus pressure signal corresponding thereto;

b) detecting near the surface of said system said noise signal in said standpipe which is transmitted to the surface from said drill bit and generating a standpipe pressure signal corresponding thereto;

c) determining the difference in arrival time at the surface of said noise signal in said annulus and said noise signal in said standpipe to produce a difference in arrival time signal $DT_{meas}$; and d) comparing said difference in arrival time signal $DT_{meas}$ with a predetermined difference in arrival time signal $DT_{alarm}$ and generating a signal if $DT_{meas} > DT_{alarm}$.

25. The method of claim 24 wherein said step of determining the difference in arrival time comprises:

determining a cross spectrum of said standpipe pressure signal and said annulus pressure signal, determining a phase signal of said cross spectrum signal as a function of frequency w;

determining a coherence signal of said cross spectrum signal as a function of frequency w; and determining said $DT_{meas}$ signal by determining the slope of said cross spectrum phase signal as a function of frequency w over a region of frequency w where said coherence signal of said cross spectrum signal is approximately unity.

26. In a borehole drilling system including a drill string terminated by a drill bit with said drill string defining an annulus between the outer diameter of said drill string and said borehole, said system including a drilling fluid pump for pumping drilling fluid downwardly through a standpipe and said drill string and upwardly through said annulus to the surface, apparatus for detecting fluid influx into the borehole comprising:

a) pressure detecting means near the surface of said system for generating an annulus pressure signal which is representative of pressure oscillation of said drilling fluid in said annulus caused by said drilling fluid pump;

b) pressure detecting means near the surface of said system for generating a standpipe pressure signal which is representative to pressure oscillation of said drilling fluid in said standpipe caused by said drilling fluid pump;

c) transform means for determining a frequency response signal H(w) proportional to the ratio of the cross spectrum of said annulus pressure signal and said standpipe pressure signal to the power spectrum of said standpipe pressure signal; and d) means for producing a gas influx alarm signal when a characteristic of the phase of said H(w) signal exceeds a predetermined threshold value.

27. The apparatus of claim 26 wherein said phase of said H(w) signal is measured in real time about an harmonic frequency of said drilling fluid pump over a predetermined frequency range to produce a variation in total transit time signal TP(t)=Delta$\phi$(t)/W.

28. The apparatus of claim 26 wherein said alarm signal producing means comprises:

means for measuring said phase of said H(w) signal in real time about a harmonic frequency of said drilling fluid pump over a predetermined frequency range;

means for producing a variation in total transit time signal TP(t)=Delta$\phi$(t)/w, where $\phi$(t) is said real time phase, Delta$\phi$(t) is the amount that said phase has increased in an arbitrary time interval, and w is said harmonic frequency; and means for comparing said TP(t) signal with a predetermined threshold to produce said gas influx alarm signal if said TP(t) signal is greater than said threshold.

29. In a borehold drilling system including a drill string in a borehole with said drill string defining an annulus between the outer diameter of said drill string and said borehole, said system including at least two drilling fluid pumps for pumping drilling fluid through a surface standpipe and thence downwardly through said drill string and upwardly through said annulus to the surface, said at least two drilling fluid pumps operating at similar but slightly different frequencies, apparatus for detecting fluid influx into said borehole comprising:

a) pressure detecting means near the surface of said system in said annulus for detecting an annulus pressure signal representative of the beat frequency pressure wave between said two pumps which has been transmitted through said drilling fluid in said standpipe, said drill string and up said annulus to the surface;

b) pressure detecting means near the surface of said system in said standpipe for detecting a standpipe pressure signal representative of the beat frequency pressure wave between said at least two pumps before said pressure wave has entered the drilling fluid in said drill string;

c) surface instrumentation means responsive to said annulus pressure signal and said standpipe pressure signal for determining the total travel time $2T_{meas}(t)$ of said beat frequency pressure wave through said standpipe, drill string and annulus; and d) means for producing a gas influx alarm signal if said total travel time signal is greater than a predetermined threshold function.

30. The apparatus of claim 29 wherein said predetermined threshold function includes a variable of rate of penetration of the drilling system while said borehole is being drilled.

* * * * *